US006588101B2

(12) United States Patent
Okubo et al.

(10) Patent No.: US 6,588,101 B2
(45) Date of Patent: Jul. 8, 2003

(54) SHEET METAL ROCKER ARM, MANUFACTURING METHOD THEREOF, CAM FOLLOWER WITH SAID ROCKER ARM, AND ASSEMBLING METHOD THEREOF

(75) Inventors: Kiyoshi Okubo, Maebashi (JP); Shoichi Abe, Gunma-gun (JP); Satoshi Kadokawa, Fujisawa (JP); Hiroshi Iwasa, Funabashi (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/254,533

(22) Filed: Sep. 26, 2002

(65) Prior Publication Data

US 2003/0029403 A1 Feb. 13, 2003

Related U.S. Application Data

(62) Division of application No. 09/912,366, filed on Jul. 26, 2001, which is a continuation of application No. 09/729,111, filed on Dec. 5, 2000, now Pat. No. 6,334,416, which is a division of application No. 09/265,957, filed on Mar. 11, 1999, now Pat. No. 6,199,527.

(30) Foreign Application Priority Data

| | | |
|---|---|---|
| Mar. 12, 1998 | (JP) | 10-078556 |
| Aug. 7, 1998 | (JP) | 10-224702 |
| Aug. 7, 1998 | (JP) | 10-224703 |
| Aug. 10, 1998 | (JP) | 10-225661 |
| Aug. 10, 1998 | (JP) | 10-226183 |

(51) Int. Cl.[7] ..... B21D 53/84

(52) U.S. Cl. ..... 29/888.2; 29/557; 123/90.39

(58) Field of Search ..... 123/90.39, 90.41; 29/888.2, 557

(56) References Cited

U.S. PATENT DOCUMENTS

| | | | | |
|---|---|---|---|---|
| 4,829,647 A | * | 5/1989 | Anderson et al. | 29/888.2 |
| 4,848,180 A | | 7/1989 | Mills | |
| 5,329,891 A | * | 7/1994 | Murphy et al. | 123/90.39 |
| 5,535,641 A | * | 7/1996 | Uchida et al. | 74/559 |
| 5,678,305 A | * | 10/1997 | Nagano et al. | 29/888.2 |
| 5,678,459 A | * | 10/1997 | Motohashi et al. | 74/559 |
| 5,720,245 A | * | 2/1998 | Calka | 123/90.41 |
| 5,799,546 A | * | 9/1998 | Pryba | 74/569 |
| 5,819,694 A | * | 10/1998 | Trutescu et al. | 123/90.43 |
| 6,021,750 A | * | 2/2000 | Hertrich | 123/90.42 |
| 6,062,184 A | * | 5/2000 | Engelhardt et al. | 123/90.41 |
| 6,199,527 B1 | * | 3/2001 | Okubo et al. | 123/9.41 |

FOREIGN PATENT DOCUMENTS

| | | | | |
|---|---|---|---|---|
| DE | 196 22 888 A1 | | 12/1997 | |
| DE | 196 45 788 A1 | | 5/1998 | |
| GB | 0779632 | * | 7/1957 | 29/888.2 |
| JP | 3121205 | | 7/1990 | |
| JP | 3-172506 | | 7/1991 | |

* cited by examiner

*Primary Examiner*—Thomas Denion
*Assistant Examiner*—Jaime Corrigan
(74) *Attorney, Agent, or Firm*—Crowell & Moring LLP

(57) ABSTRACT

A sheet metal rocker arm manufactured by the steps of punching one metal plate to form a blank having a predetermined contour and through holes, and subjecting this blank to a bending work based on a press work to form a pair of side walls parallel to each other and a connecting portion for connecting the both ends of the side walls in the width direction thereof. This rocker arm is also provided with at least a pair of though holes formed at positions which are aligned with each other on the both side walls and at least one engagement portion provided in a part of the connecting portion. The thickness of at least one engagement portion, is formed to be greater than the thickness of the both side walls.

2 Claims, 20 Drawing Sheets

FIG. IID
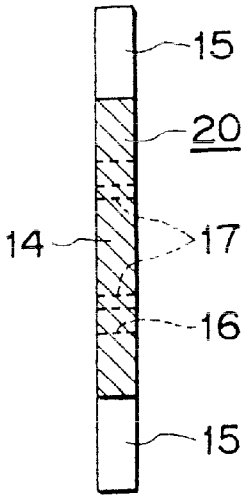
FIG. IIA
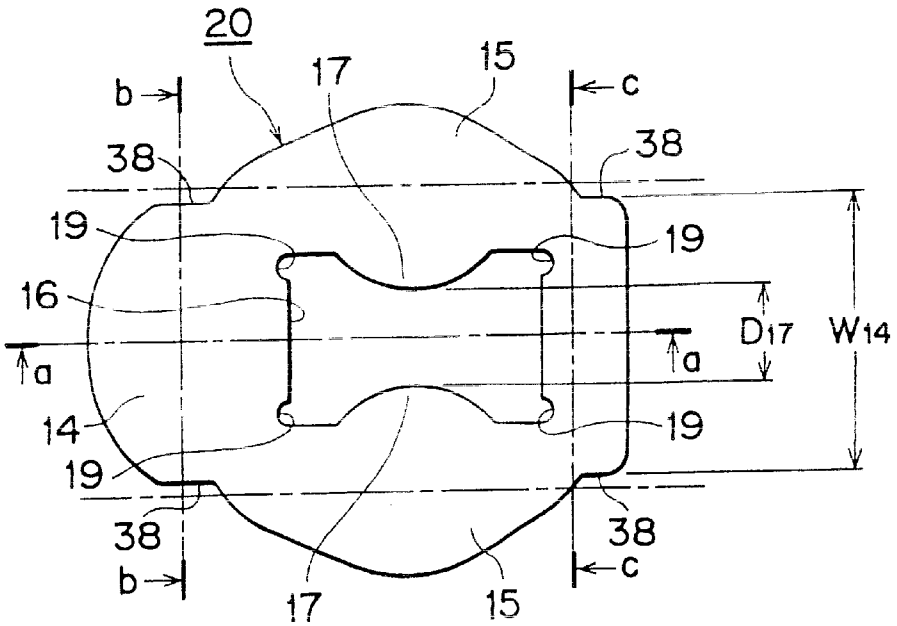
FIG. IIB
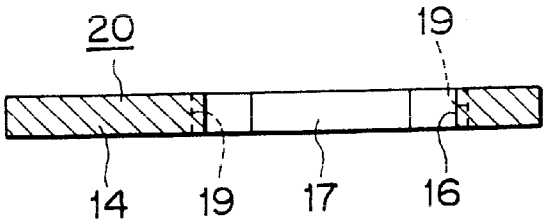
FIG. IIC
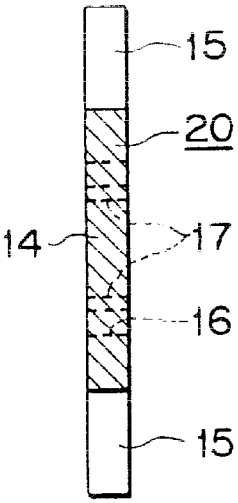

SHEET METAL ROCKER ARM, MANUFACTURING METHOD THEREOF, CAM FOLLOWER WITH SAID ROCKER ARM, AND ASSEMBLING METHOD THEREOF

This application is a division of application Ser. No. 09/912,366, filed Jul. 26, 2001 which is a continuation of application Ser. No. 09/729,111, filed Dec. 5, 2000, now U.S. Pat. No. 6,334,416, issued Jan. 1, 2002, which is a division of application Ser. No. 09/265,957, filed Mar. 11, 1999, now U.S. Pat. No. 6,199,527, issued Mar. 13, 2001.

This application claims the benefits of Japanese Application Nos. 10-078556, 10-224702, 10-224703, 10-225661 and 10-226183 which are hereby incorporated by reference.

BACKGROUND OF THE INVENTION

The present invention relates to a rocker arm made of sheet metal which is manufactured by a press work from a metal plate, out of rocker arms incorporated in a valve driving mechanism of an engine for converting a rotation of a cam shaft to a reciprocating motion of a valve unit (including a suction valve and an exhaust valve), as well as an improvement in a manufacturing method thereof.

The present invention also relates to a cam follower provided with a sheet metal rocker arm and an improvement in an assembling method thereof.

A reciprocating engine (reciprocating piston engine) is provided with a suction valve and an exhaust valve which opens and closes in synchronism with a rotation of a crank shaft, except a two-cycle engine provided in certain types. In such a reciprocating engine, a motion of a cam shaft which rotates in synchronism with a rotation of the crank shaft (at a rotation speed of ½ in case of a four-cycle engine) is transmitted to the intake valve and the exhaust valve by use of a rocker arm, and the intake valve and the exhaust valve are reciprocated along the axial direction.

Conventionally, such a rocker arm incorporated in the valve driving mechanism of the engine is generally formed by casting (as a cast iron or aluminum die cast product). However, a cast product is too weighty (in case of an iron cast) or bulky (in case of an aluminum die cast) for maintaining a sufficient strength. In addition, since the rocker arm is generally manufactured by a lost wax method, the manufacturing cost is unavoidably increased. For this reason, it is recently considered to manufacture such rocker arm by a press work from a metal plate such as a steel plate, which is partially realized.

A conventional manufacturing method of a sheet metal rocker arm considering such circumstances is disclosed in, for example, Japanese Patent Application Laid-Open No. 3-172506. FIGS. 19 to 22 show the manufacturing method of a sheet metal rocker arm disclosed in this application. According to this conventional method, first a metal plate (such as a carbon steel plate having the thickness of 2 to 4 mm) as blank is punched by the press work, so as to form a blank 1 having a shape as shown in FIG. 19A and the thickness of t1, as shown in FIG. 19B.

Next, this blank 1 is subjected to a bending work by press to form a first intermediate blank 2 as shown in FIGS. 20A and 20B. This first intermediate material 2 comprises a pair of side walls 3, 3 parallel to each other, a connecting portion 4 for connecting the edges of the both side walls 3, 3 in the width direction, a roller receiving recess 5 formed in a middle part of a space surrounded in three directions by the both side walls 3, 3, and the connecting portion 4, and a pivot portion 6 as a spherical concave surface formed in a middle part at a position nearer one end of the connecting portion 4.

Subsequently, a through hole 7 which has a Japanese hand drum shape when seen from the side parallel to the side walls 3, 3, as shown in FIGS. 21A and 21B, is formed in a portion which is a part of the connecting portion 4 for forming the first intermediate blank 2 as described above and is corresponding to the roller receiving recess 5, as a second intermediate blank 8. Arched protrusions 9, 9 which are part of the second intermediate blank 8 are provided to sandwich this through hole 7 from the both sides thereof in the width direction (the up-and-down direction in FIG. 21A) in a state that the protruding edges of both of the protrusions 9, 9 are placed opposite to each other. The through hole 7 has a narrower width W7 at the center thereof, compared with the width at a part nearer either of the ends thereof.

When a part surrounding the though hole 7 of the second intermediate blank 8 as described above is subjected to burring and ironing, a third intermediate blank 10 as shown in FIG. 22 is obtained. In this third intermediate blank 10, the through hole 7 becomes an opening 11 which has a rectangular shape when seen from the side parallel to the side walls 3, 3, and the shape of the other end portion of the connecting portion 4 is adjusted to become a valve engagement portion 12 for abutting on the base end portion of the valve unit constituting the suction valve or the exhaust valve. At the subsequent step, in the third intermediate blank 10 as described above, circular holes for supporting the both ends of a support shaft for supporting to allow free rotation a roller which is engaged with the cam are formed at positions aligned with each other on both of the side walls 3, 3, thereby completing a sheet metal rocker arm. Then, in a state that such sheet metal rocker arm is assembled in the engine, the outer peripheral surface of the roller which is supported by the roller receiving portion 5 in a rotating manner is brought into contact with the outer peripheral surface of the cam, the leading end portion of a lash adjuster is caused to abut upon the pivot portion 6, and the base end surface of the suction valve or the exhaust valve is caused to abut upon the valve engagement portion 12.

The thickness t3 of each of the laterally paired side walls 3, 3 for constituting the sheet metal rocker arm manufactured in the manner described above is substantially equal to the thickness t1 of the blank 1 (FIG. 19B) (t3≈t1). The thickness t3 of each of the both side walls 3, 3 and the thickness t4 of the connecting portion 4 including the pivot portion 6 and the valve engagement portion 12 (FIG. 22B) are also substantially equal to the thickness t1 of the blank 1 (t1≈t3≈t4).

More specifically, since formed of one metal plate in a unitary structure mainly by the press work, the conventional sheet metal rocker arm mentioned above has substantially a uniform thickness over the entire surface thereof except a part of the pivot portion 6 and a part followed by a part of the metal plate. Also, in case of a conventional technology other than Japanese Patent Application Laid-Open No. 3-172506 mentioned above, a sheet metal rocker arm which is formed of one metal plate in a unitary structure mainly by the press work has substantially a uniform thickness over the entire surface thereof.

On the other hand, there is conventionally known a structure of a rocker arm in which two or three members respectively formed by the press work of a metal plate are connected and fixed to each other by welding. In case of a sheet metal rocker arm which is formed by combining plural members as stated, the thickness of the connecting portion including the pivot portion and the valve engagement portion is formed greater than the thickness of each of the side walls.

According to the conventional technology described above, inconveniences as stated below will be brought about. First, according to the technology disclosed in Japanese Patent Application Laid-Open No. 3-172506 for forming a sheet metal rocker arm from one metal plate in a unitary structure, the thickness of the formed sheet metal rocker arm is uniform substantially over the entire surface thereof. On the other hand, when the rocker arm is in use, a stress acting on the connecting portion 4, specially that acting in the vicinity of the valve engagement portion 12, is greater, compared with that stress acting on another portion such as the side walls 3, 3. For this reason, when the thickness is uniform, the connecting portion 4, specially in the vicinity of the valve engagement portion 12, is disadvantageous in terms of the strength, compared with other portions, and the rigidity also may be lowered in some cases. In case of the conventional technology, the thickness of the metal plate for forming the sheet metal rocker arm is made to be great in order to secure a sufficient strength and rigidity of a portion in the vicinity of the valve engagement portion 12. Consequently, the thickness of the other portions such as the side walls 3, 3 is greater than that originally required, so that the size and the weight of the sheet metal rocker arm can not be sufficiently reduced. In addition, the cost of materials is increased.

In case of the sheet metal rocker arm in which two or three members respectively formed of a metal plate by the press work are connected and fixed to each other by welding, the thickness of the connecting portion including the valve engagement portion can be made greater than the thickness of another portion such as the side wall. On the other hand, however, after plural members are formed separately, these members are required to be combined with each other and bonded together by welding. Consequently, the number of processing steps increases and an extra labor is required for controlling the constituent parts. Since a complicated and precise equipment is required for positioning the respective members when they are assembled, it is unavoidable to increase the cost, as well as to increase the number of processing steps and to require an extra labor for controlling the parts. Moreover, the quality of the obtained sheet metal rocker arm (precision) is often inferior to that of the rocker arm formed in a unitary structure.

Though having a superior toughness to the cast-type rocker arm, the sheet metal rocker arm may be elastically deformed more easily depending on a direction of action of the force. That is, since each of the paired walls 3, 3 for bridging the both ends of a pivot for supporting the roller takes a flat-plate shape, if a force in a right-angled direction is applied on the side walls 3, 3, the side walls 3, 3 are elastically deformed comparatively easily. On the other hand, when the both ends of the pivot is caulked toward the inner peripheral surfaces of both of the through holes for connecting and fixing the both ends of the pivot to each other, a force is applied onto portions which are provided on the side walls 3, 3 with the through holes formed thereon in a direction in which the both portions come toward each other. Then, the side walls 3, 3 are elastically deformed on the basis of this force.

In case of the conventional sheet metal rocker arm, the paired side walls 3, 3 are formed to be parallel to each other in a state prior to that the both ends of the pivot are caulked. For this reason, in a state in which the both ends of the pivot are caulked toward the inner peripheral surfaces of the through holes, the paired side walls 3, 3 are formed to be non-parallel to each other. Accordingly, the inner side surfaces (the side surfaces opposite to each other) of the side walls 3, 3 and the both end surfaces in the axial direction of the roller supported in a middle part of the pivot in a rotating manner are formed to be non-parallel to each other. As a result, the so-called edge abutment is brought about in which the inner side surfaces of the side walls 3, 3 and the both end surfaces of the roller in the axial direction are not brought into contact with each other in a uniformly wide area, but may be brought into contact with each other in a very narrow area, or the edges of the side walls 3, 3 and the both end surfaces of the roller in the axial direction are brought into contact with each other.

In such a state, it is difficult to satisfactorily form between the inner side surfaces of the side walls 3, 3 and the respective both end surfaces of the roller in the axial direction an oil film for decreasing a friction between these both surfaces. This is not preferable since a resistance required for a rotation of the roller may be increased, or an amount of abrasion of the roller or the sheet metal rocker arm may be increased.

When the cam follower with the sheet metal rocker arm is in use, the roller is rotated inside the roller receiving recess 5, which is provided on this sheet metal rocker arm. When this roller is displaced in the axial direction with respect to the pivot which is supported on and fixed to the sheet metal rocker arm, the end surface of the roller in the axial direction and the inner side surface of one of the side walls 3 rub against each other. Accordingly, it is required to decrease a frictional resistance of a contact portion between these end surfaces of the roller in the axial direction and the inner side surfaces of the side walls 3, 3 for reducing a rotational resistance of the roller and for reducing abrasion of this roller and the sheet metal rocker arm.

However, in case of the cam follower provided with the conventional sheet metal rocker arm, such requirements are not always taken into consideration.

SUMMARY OF THE INVENTION

A sheet metal rocker arm according to the present invention and a method of such rocker arm have been conceived to solve any of the above-described inconveniences.

According to the present invention, there is provided a sheet metal rocker arm manufactured by the steps of punching one metal material to form a blank having a predetermined contour and through holes, and subjecting this blank to a bending work based on a press work to form a pair of side walls parallel to each other and a connecting portion for connecting the both ends of the both side walls in the width direction thereof. This rocker arm is also provided with at least a pair of though holes formed at positions which are aligned with each other on the both side walls and at least one engagement portion provided in a part of the connecting portion. The thickness of the part in which at least one engagement portion is provided, out of this connecting portion, is formed to be greater than the thickness of the both side walls by increasing the thickness of the part in which at least one engagement portion is provided, out of this connecting portion, by the press work.

According to the method of manufacturing a sheet metal rocker arm of the present invention, when the sheet metal rocker arm as described above is manufactured, the blank is subjected to the bending to form both of the side walls, and a portion corresponding to the connecting portion is curved to have an arched section, thereby forming the curved portion. Then, a pressing work is conducted to strongly press this curved portion to be plastically deformed. Thus, the thickness of this curved portion is increased and an engagement portion is formed in this curved portion.

According to the sheet metal rocker arm of the present invention having the above-mentioned structure and the manufacturing method of such rocker arm, though the rocker arm is formed from one metal plate in a unitary structure having the uniform thickness, the thickness of the connecting portion including the valve engagement portion can be made greater than the thickness of the paired side walls. Consequently, it is possible to reduce a stress acting on the connecting portion including this valve engagement portion to secure a strength and a rigidity of the sheet metal rocker arm without unnecessarily increasing the weight of the rocker arm. It is suffice if the thickness of the side walls is great enough to secure the strength and the rigidity required for these side walls, and the thickness is not required unnecessarily great. Thus, it is possible to reduce the width of the sheet metal rocker arm, which is a distance between the outer side surfaces of the both side walls, so that a design incorporating this sheet metal rocker arm into a limited space inside the engine becomes easier.

Moreover, since the whole sheet metal rocker arm is formed from one metal plate in a unitary integral structure, an extra labor for connecting plural members separately manufactured is not necessary, thereby decreasing the number of the processing steps and preventing an increase in manufacturing cost as well as deterioration in precision. In addition, it is possible to save a complicated mechanism for assembly and positioning, so as to manufacture a sheet metal rocker arm with a high quality at a low cost. Further, it is possible to carry out a work for increasing the thickness of the connecting portion only by the press work without introducing a special equipment. For this reason, it is possible to suppress investment in equipment and to realize a sheet metal rocker arm with a high quality at a low cost by saving a labor with automated manufacturing steps.

The present invention has been contrived to further reduce the size and the weight of the sheet metal rocker arm. More specifically, when the sheet metal rocker arm is used, a stress is generated in each part based on a load applied from the valve unit and the lash adjuster. Unless the shape and the size of each constituent part are selected in relation with this load, the magnitude of this stress is in the respective parts. Naturally, in order to secure a sufficient durability of the sheet metal rocker arm, the rigidity of even a part in which a stress with the greatest magnitude is generated is secured so that the rigidity of this part does not exceed the allowed value. In such a case, however, a rigidity in other parts becomes excessive. The excessive rigidity hinders reduction of the size and the weight of the sheet metal rocker arm and is not preferable.

The sheet metal rocker arm of the present invention has been contrived considering the above-mentioned circumstances.

The sheet metal rocker arm of the present invention is manufactured by subjecting one metal plate to punching and bending. The sheet metal rocker arm is provided with a pair of side walls which are substantially parallel to each other, a connecting portion for connecting the respective end edges of both of the side walls in the width direction, a pair of through holes formed at positions aligned with each other on the side walls, a first engagement portion provided in a part of the connecting portion to abut upon the base end portion of a valve unit, and a second engagement portion provided in another part of this connecting portion to abut upon the leading end portion of a rush adjuster.

Specially, in the sheet metal rocker arm of the present invention, the thickness of the first engagement portion is formed to be greater than that of the side wall. Both of the side walls in a state that they stand up from the connecting portion, are not formed over the entire edge portions of the both sides of these first and second engagement portions. The forms and the sizes of the respective parts are restricted so that a ratio of the maximum value to the minimum value of the stress generated in the first and second engagement portion is within five, based on the load applied to the first and second engagement portions from the valve unit and the rush adjuster.

According to the sheet metal rocker arm of the present invention having such structure as described above, though the rocker arm is formed of one metal plate having the uniform thickness in a unitary integral structure, the thickness of the connecting portion for constituting the first engagement portion is formed to be greater than that of the paired side walls. Accordingly, it is possible to secure the strength and the rigidity of the sheet metal rocker arm by decreasing a stress acting on the first engagement portion, without unnecessarily increasing the weight of the rocker arm. It is suffice if the thickness of the side walls is enough to maintain the strength and the rigidity required for these side walls and is not required to be unnecessarily great. Consequently, it is possible to reduce the width of the sheet metal rocker arm, which is a distance between the outer side surfaces of the side walls so that it becomes easier to incorporate this rocker arm within a limited space inside the engine.

Moreover, since the whole sheet metal rocker arm is formed of one metal plate in a unitary integral structure, a trouble for connecting the plural constituent members that are separately manufactured to each other, is eliminated, which results in the reduced number of processing steps to prevent an increase of the manufacturing cost and deterioration in accuracy. It is also possible to manufacture the sheet metal rocker arm with a high quality at a low cost without providing unnecessary complicated equipment for the assembly and positioning.

Out of the side walls to which a great stress is not applied when the rocker arm is in use, the both side edge portions of the first and second engagement portions are partially omitted except a part required for supporting the pivot for supporting the roller. Further, since the forms and the sizes of the, respective parts are restricted in such a manner that a ratio of the maximum value to the minimum value of a stress generated in these first and second engagement portions is within five, there is no part having an excessive rigidity. Thus, the effect of reducing the weight of the sheet metal rocker arm as a whole becomes more excellent.

A cam follower which is provided with the sheet metal rocker arm of the present invention and an assembling method thereof have been contrived to solve problems as described above.

Out of the cam follower provided with the sheet metal rocker arm of the present invention and the assembling method thereof, the cam follower provided with a sheet metal rocker arm comprises a sheet metal rocker arm provided with a pair of side walls which are formed of a metal plate to be substantially parallel to each other and a connecting portion for connecting these side walls to each other, a pivot which is fixed to bridge over the paired side walls by caulking the both ends thereof toward the inner peripheral surfaces of a pair of through holes in a state that the pivot bridges over the paired through holes formed at positions aligned with each other on the side walls, and a roller supported rotatably around a middle part of this pivot.

Specially, in the cam follower provided with the sheet metal rocker arm of the present invention, it is preferable to make the paired side walls to be parallel to each other in a state that the both ends of this pivot are caulked, by forming a gap between the portions at which the through holes are formed, out of the paired side walls, in a state prior to that the both ends of the pivot are caulked, to be wider than this gap in a state that the both ends of the pivot have been caulked.

Specially, in the assembling method of the cam follower which is provided with the sheet metal rocker arm of the present invention, a gap between the portions at which the through holes are formed, out of the pair of side walls, in a state prior to the caulking the both ends of the pivot, is formed to be wider than this gap in a state that the both ends of this pivot have been caulked. Then, it is preferable to form the paired side walls to be parallel to each other by reducing the gap between the portions at which the through holes are formed on the paired side walls, upon the caulking of the both ends of this pivot.

According to the cam follower provided with the sheet metal rocker arm of the present invention having the structure as mentioned above and the assembling method thereof, in a state that the sheet metal rocker arm, the roller, and the pivot are combined with each other and the both ends of this pivot are connected and fixed to the paired side walls for constituting this sheet metal rocker arm, both of these side walls and the both end surfaces of the roller in the axial direction can be formed to be parallel to each other. Consequently, it is possible to sufficiently form between the inner side surfaces of the side walls and the both end surfaces of the roller in the axial direction an oil film for reducing a friction between these surfaces, thereby reducing a resistance required for rotating the roller and reducing an amount of abrasion of the roller and the sheet metal rocker arm.

The cam follower provided with the sheet metal rocker arm of the present invention has been contrived considering these circumstances to reduce a frictional resistance in a contact portion between the end surfaces of the roller in the axial direction and the inner side surfaces of the side walls.

Any cam follower provided with the sheet metal rocker arm of the present invention comprises a pair of side walls which are formed of a metal plate to be parallel to each other, a sheet metal rocker arm provided with a connecting portion for connecting these side walls; a pivot fixed to bridge over the paired side walls by supporting the both end portions thereof at a pair of through holes formed a positions aligned with each other on the both side walls, and a roller supported rotatably around a middle part of this pivot.

In the cam follower provided with the sheet metal rocker arm, a recess for receiving lubricating oil is preferably formed on the inner side surface of at least one side walls out of the paired side walls in such a manner that one end thereof is open at the outer edge of said side wall and the recess is inclined in a direction which becomes shallower toward the opposite end.

In the cam follower provided with the sheet metal rocker arm, the degree of flatness of the inner side surface of each of the side walls is preferably not more than 10 $\mu$m, and the surface roughness thereof not more than 0.3 $\mu$Ra.

Also, in the cam follower provided with the sheet metal rocker arm, it is preferable to conduct a solid lubricating film coating or soft nitriding at least on the inner side surface of the side walls to reduce a frictional coefficient of this inner side surface.

Further, in the cam follower provided with the sheet metal rocker arm, it is preferable to provide washers rotatably around the pivot between the inner side surfaces of the side walls and the both end surfaces of the roller in the axial direction or the both end surfaces of a needle for constituting a radial needle bearing provided on the inner diameter side of this roller.

According to any cam follower provided with the sheet metal rocker arm of the present invention having a structure as mentioned above, it is possible to reduce a frictional resistance between the end surfaces of the roller in the axial direction and the inner side surface of the side walls to reduce a rotational resistance of this roller, and to reduce abrasion of this roller and the sheet metal rocker arm.

BRIEF DESCRIPTION OF THE DRAWINGS

FIGS. 3A to 3D show a first blank obtained by a first step when the sheet metal rocker arm is manufactured, in which FIG. 3A is a plan view of the first blank, FIG. 3B is a cross-sectional view taken along a—a in FIG. 3A, FIG. 3C is a cross-sectional view taken along b—b in FIG. 3A, and FIG. 3D is a cross-sectional view taken along c—c in FIG. 3A.

FIGS. 4A to 4D show a second blank obtained by a second step in the same manner, in which FIG. 4A is a plan view of the second blank, FIG. 4B is a cross-sectional view taken along a—a in FIG. 4A, FIG. 4C is a cross-sectional view taken along b—b in FIG. 4A, and FIG. 4D is a cross-sectional view taken along c—c in FIG. 4C.

FIGS. 5A to 5D show a first intermediate blank obtained by a third step in the same manner, in which FIG. 5A is a plan view of the first intermediate blank, FIG. 5B is a cross-sectional view taken along a—a in FIG. 5A, FIG. 5C is a cross-sectional view taken along b—b in FIG. 5A, and FIG. 5D is a cross-sectional view taken along c—c in FIG. 5D.

FIGS. 6A to 6D show a second intermediate blank obtained by a fourth step in the same manner, in which FIG. 6A is a plan view of the second intermediate blank, FIG. 6B is a cross-sectional view taken along a—a in FIG. 6A, FIG. 6C is a cross-sectional view taken along b—b in FIG. 6A, and FIG. 6D is a cross-sectional view taken along c—c in FIG. 6C.

FIGS. 7A and 7B show a progress of the fourth step, in which FIG. 7A is a partially-enlarged cross sectional view for showing a state prior to urging of a curved portion, and FIG. 7B is a partially-enlarged cross sectional view for showing a state that the curved portions is urged to become a connecting portion, respectively.

FIGS. 8A to 8D show a third intermediate blank obtained by a fifth step in the same manner, in which FIG. 8A is a plan view of the third intermediate blank, FIG. 8B is a cross-sectional view taken along a—a in FIG. 8A, FIG. 8C is a cross-sectional view taken along b—b in FIG. 8A, and FIG. 8D is a cross-sectional view taken along c—c in FIG. 8C.

FIGS. 9A to 9D show an auxiliary intermediate blank manufactured by an auxiliary urging step in a second example of the manufacturing method of a sheet metal rocker arm of the present invention, in which FIG. 9A is a plan view of the auxiliary intermediate blank, FIG. 9B is a cross-sectional view taken along a—a in FIG. 9A, FIG. 9C is a cross-sectional view taken along b—b in FIG. 9A, and FIG. 9D is a cross-sectional view taken along c—c in FIG. 9C.

FIGS. 10A and 10B show a progress of the auxiliary pressing step, in which FIG. 10A is a partially enlarged cross sectional view for showing a state prior to that pressing of a curved portion, and FIG. 10B is a partially-enlarged cross sectional view for showing a state that the curved portions is pressed, respectively.

FIGS. 11A to 11D show the second blank manufactured through a second step according to a third embodiment of the present invention, in which FIG. 11A is a plan view of the second blank, FIG. 11B is a cross-sectional view taken along a—a in FIG. 11A, FIG. 11C is a cross-sectional view taken along b—b in FIG. 11A, and FIG. 11D is a cross-sectional view taken along c—c in FIG. 11C.

FIG. 12A illustrates a state prior to caulking the both end portions of a pivot, and FIG. 12B illustrates a state after caulking these portions, respectively.

FIG. 19A is a plan view of the blank, and FIG. 19B is a cross-sectional view taken along a—a in FIG. 19A.

FIG. 20A is a plan view of the first intermediate embodiment, and FIG. 20B is a cross-sectional view taken along a—a in FIG. 20A.

FIG. 21A and FIG. 21B show the second intermediate blank manufactured by the third step in the same manner, in which FIG. 21A is a plan view of the second intermediate blank, and FIG. 21B is a cross-sectional view taken along a—a in FIG. 21A.

FIG. 22A and FIG. 22B show the third intermediate embodiment manufactured by the fourth step in the same manner, in which FIG. 22A is a plan view of the third intermediate blank, and FIG. 22B is a cross-sectional view taken along a—a in FIG. 22A.

DESCRIPTION OF THE PREFERRED EMBODIMENTS

Figure 1:
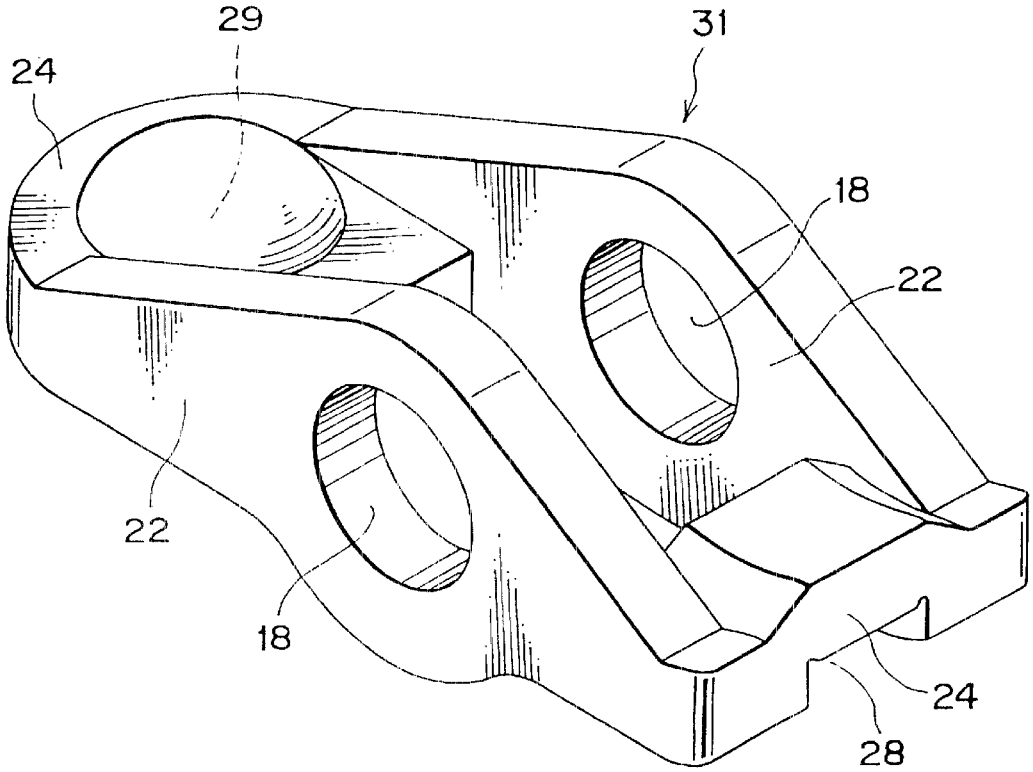
FIG. 1 is a perspective view of a sheet metal rocker arm according to a first embodiment of the present invention.

FIG. 1 shows a first embodiment of the present invention. Referring to FIG. 1, a sheet metal rocker arm 31 is manufactured in a unitary structure by conducting a punching and a bending based on a press work of one metal plate such as a low carbon carburizing steel plate. This sheet metal rocker arm 31 is provided with a pair of side walls 22, 22 which are substantially parallel to each other, connecting portions 24, 24 for connecting the edge ends of the both side walls 22, 22 in the width direction thereof, and a pair of through holes 18, 18 formed at the positions each in a middle part of the side wall, aligned to each other.

At one end portion of the connecting portions 24 (the right end portion in FIGS. 2A and 2B), there is formed a first engagement portion 28 for abutting on the base end portion of a valve unit in a state that it is incorporated in the engine. Of this first engagement portion 28, a middle part in the width direction (the up-and-down direction in FIGS. 2A and 2B) at one end portion of the connecting portions 24 is depressed to become a curved surface which is concave along the width direction and the length direction (the lateral direction in FIGS. 2A and 2B). On the other hand, at the other end (the left end portion in FIGS. 2A and 2B) of the connecting portions 24, there is formed a second engagement portion 29 for abutting on the leading edge of a rush adjuster in a state that it is incorporated in the engine. This second engagement portion 29 is formed as a curved surface by depressing the center of the above other end of the connecting portion 24 in a spherical form.

The thickness T24 of the connecting portions 24 with the first engagement portion 28 and the second engagement portion 29 thus formed thereon is set to be greater than the thickness T22 of the side walls 22, 22 (T24≧T22). In each connecting portion 24, the both side walls 22, 22 which stand up from the connecting portion 24 exist partly but do not cover the entire edge portions on the both side edges of the first and second engagement portions 28 and 29. More specifically, the side walls 22, 22 are widest at the centers thereof in the length direction at which the through holes 18, 18 are formed, and gradually become narrower toward the both end portions in the length direction at which they are connected to the respective connecting portions 24. The thickness of the side walls at these end portions is substantially equal to the thickness T24 of this connecting portions 24. Consequently, on the connecting portions 24, the side walls 22, 22 are formed only partially on the both side edge portions of the first and second engagement portions 28 and 29.

The forms and the sizes of the respective members are restricted such that a ratio of the maximum value to the minimum value of the stress generated in these first and second engagement portions 28 and 29 based on loads applied onto the first and second engagement portions 28 and 29 from the unshown valve unit and lash adjuster incorporated into the engine is not more than 5. That is, when the rocker arm is incorporated into the engine, the base end portion of the valve unit (not shown) is caused to abut on the first engagement portion 28 and the leading edge of the unrepresented lash adjuster on the second engagement portion 29, respectively. When the engine is driven, the valve unit or the lash adjuster strongly urges the first engagement portion 28 or the second engagement portion 29, thereby generating a stress in the first or second engagement portion 28 or 29, in the sheet metal rocker arm 31. Naturally, the rigidity of such portion is secured such that a sufficient durability can be secured even in a portion in which a stress is easily generated, based on the above-mentioned load. However, a ratio of the maximum value to the minimum value of a stress generated in each portion is kept within 5 by setting the rigidity of a portion in which a stress is difficult to be generated not to be excessive.

In spite that the sheet metal rocker arm 31 of the present invention is formed of one metal plate having a uniform thickness as a unitary integral unit as described above, the thickness of the connecting portion 24 for constituting the first engagement portion 28 in which a large stress tends to be generated is formed to be greater than the thickness of the paired side walls 22, 22 in which a large stress is seldom generated. Consequently, it is possible to secure sufficient strength and rigidity of the sheet metal rocker arm 31 by reducing a stress acting on the first and second engagement portions 28 and 29 without unnecessarily increasing the weight thereof. On the other hand, the thickness of the side walls 22, 22 suffices if it can secure the strength and rigidity required for the side walls 22, 22, and is not required to be unnecessarily great. Consequently it is possible not only to reduce the width of the sheet metal rocker arm 31, which is a gap between the outer side surfaces of the both side walls 22, 22, thereby reducing the weight of the rocker arm, but to design more easily to incorporate this sheet metal rocker arm 31 in a limited space inside the engine.

Moreover, since the whole sheet metal rocker arm 31 is integrally formed of one sheet of metal plate, a problem in connecting plural constituent members which are manufactured separately from each other is not required and the number of the manufacturing steps can be reduced. At the same time, it is possible to prevent increase of the manufacturing cost and deterioration in an accuracy, whereby the sheet metal rocker arm 31 with high quality can be manufactured at a low cost without complicated equipment for assembling and positioning.

Out of the both side walls 22, 22 to which a large stress is not applied when the rocker arm is in use, both side edge portions of the connecting portions 24 provided respectively with the first and second engagement portions 28 and 29 are partially omitted except the central portion in the length direction which is required for supporting a pivot for supporting a roller. Further, the forms and the sizes of the respective members are restricted such that a ratio between the maximum value and the minimum value of a stress generated in the first and second engagement portions 28 and 29 is kept within 5. For this reason, there exist no portion which has an excessive rigidity, compared with the generated stress. With these arrangements, the weight of the whole sheet metal rocker arm 13 can be reduced more effectively.

In the conventional rocker arm, it is required to provide side walls all over the engagement portions to secure the rigidity. However, in the sheet metal rocker arm of the present invention, it is possible to secure the rigidity by increasing the plate thickness of the engagement portions even if the side walls are not provided all over the engagement portions. That is, even if an area for the side walls is decreased, compared with that of the conventional rocker arm, the performance of the rocker arm does not become inferior to that of the conventional one. Further, the weight of this rocker arm may be reduced corresponding to the reduced area for the side walls.

Next, an example of a method of manufacturing a sheet metal rocker arm as mentioned above will be described with reference to FIGS. 3 to 8.

When a sheet metal rocker arm of the present invention is to be manufactured by the manufacturing method of the present invention, a first blank 13 as shown in FIGS. 3A to 3D is prepared at a first step. More specifically, at this first step, a metal plate (a flat plate blank or a coil blank) having a sufficient rigidity, such as a carbon steel having the thickness of, for example, 3 mm to 4 mm is placed between a punch and a counterpunch of a pressing machine (not shown) to prepare the first blank 13 by punching.

Figure 3D:
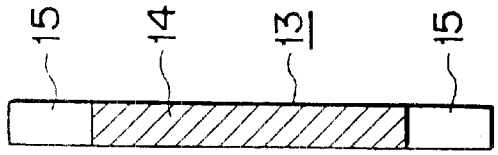
Figure 3A:
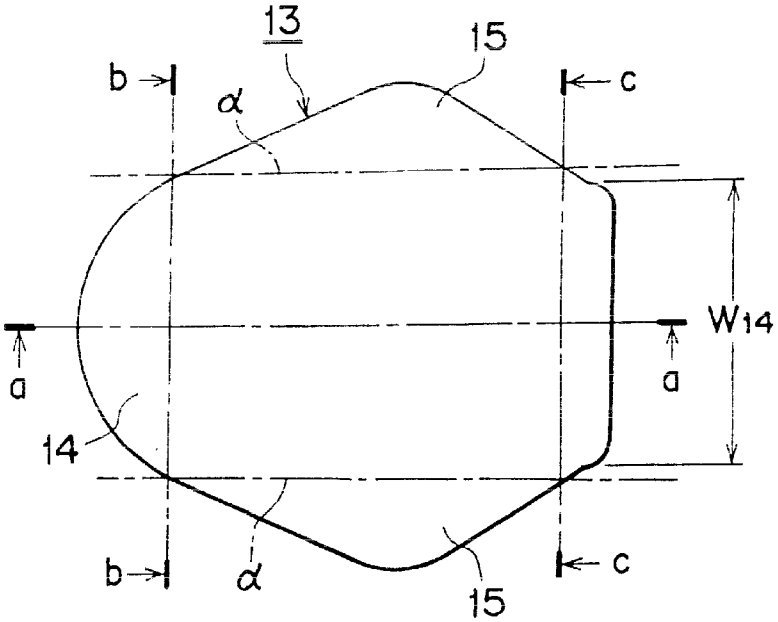
Figure 3B:
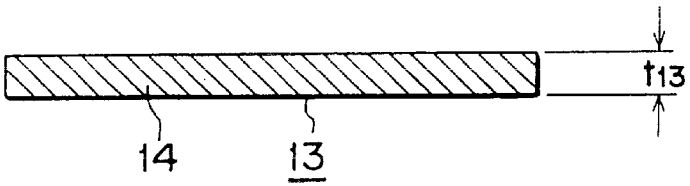
Figure 3C:
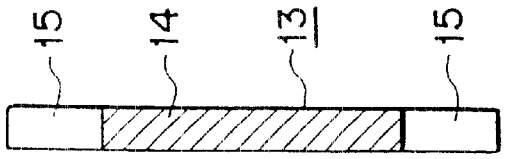

This first blank 13 has, as shown in FIG. 3A, a lozenge shape with round corners and having a cut-away part at one end in the length direction thereof (the right end portion in FIG. 3A), and the thickness of t13 (FIG. 3B). A portion having the width W14 located slightly inside two chain lines α, α shown in FIG. 3A (a portion nearer the center in the width direction) in a central part in the width direction (the up-and-down direction in FIG. 3A) of the first blank 13 is called the base portion 14 which is connected to the length direction (the lateral direction in FIG. 3A) of the first blank 13. Then, on the both sides of this base portion 14 in the width direction, a pair of wing-shaped portions 15, 15 each having a substantial triangular shape are formed. The outer periphery of the base portion 14 and the outer peripheries of these wing-shaped portions 15, 15 are smoothly connected to each other in a straight line or a curved line. In other words, there is formed no pointed part in which a stress is easily concentrated. Note that the shape of the base portion 14 is not necessarily limited to that shown in the drawings. The base portion 14 may take a suitable shape in accordance with a finished shape of a sheet metal rocker arm to be manufactured.

Figure 4D:
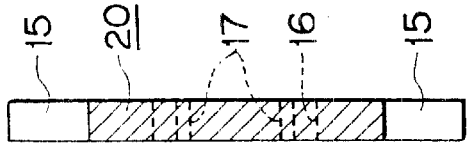
Figure 4A:
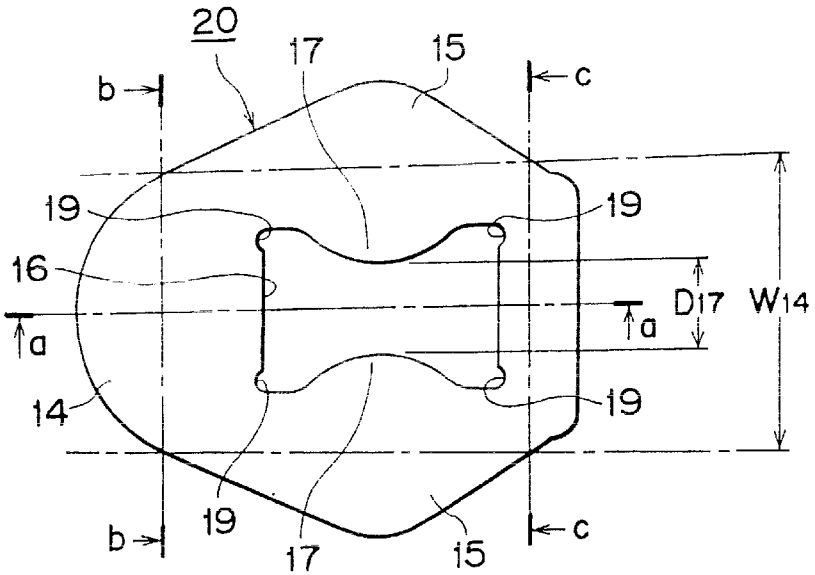
Figure 4B:
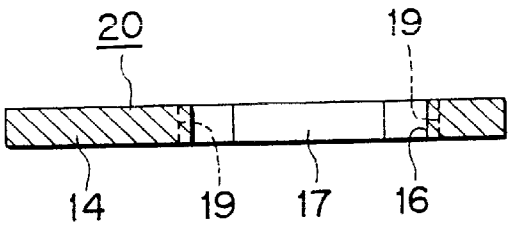
Figure 4C:
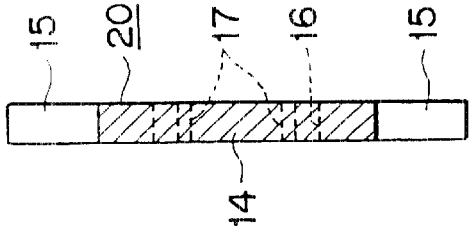

In the central part of the first blank 13 described above, there is formed a through hole 16 at a subsequent second step, as shown in FIG. 4A, to form a second blank 20. This through hole 16 takes a substantial Japanese hand drum shape having a pair of flap portions which are partial arched parts respectively projecting toward each other in the central part in the length direction of the both side edges in the width direction. These flap portions 17, 17 are provided to form circular holes 18, 18 (see FIGS. 1 and 2) for respectively supporting the both ends of a support shaft for supporting rotatably a roller (which is described later). At the four corners of the through hole 16, there are formed cut-away portions 19, 19 each taking a substantial semi-circular shape. These cut-away portions 19, 19 are formed to facilitate the bending work to be carried out at a next third step in which a curved portion 21 (see FIGS. 5A to 5D) are formed by bending the base portion 14 to have an arched section.

Figure 21A:
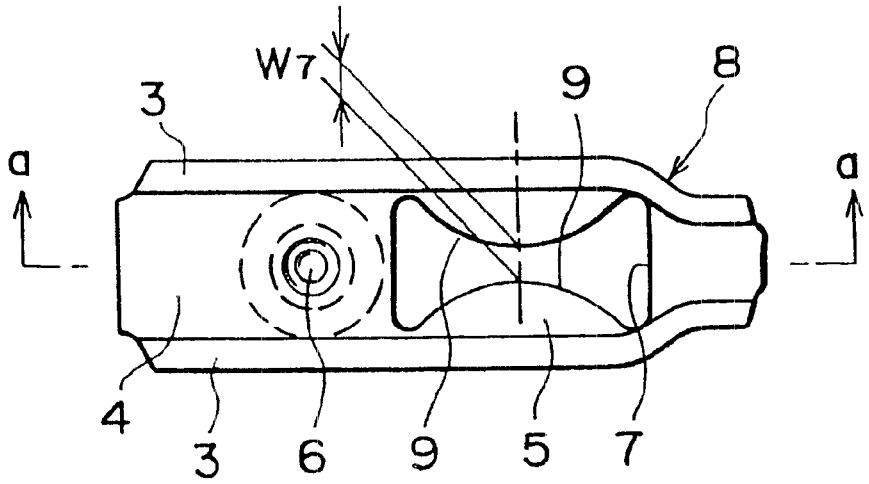
FIG. 21A PRIOR ART

The second blank 20 as described above is formed by placing the first blank 13 between the piercing punch and the piercing die of the pressing machine incorporated in a press processing machine (not shown), and then punching the through hole 16 between the punch and the counterpunch. Note that the width W14 of the base portion 14 of the first blank 13 as well as the second blank 20 is formed greater than the width W23 of a first intermediate blank 23 (see FIGS. 5C and 5D) which is a space between the outer side surfaces of the paired side walls manufactured at the third step described next (W14>W23). Since the width W14 of the base portion 14 is formed greater than the width W23 of the first intermediate portion 23 in this manner, a distance D17 between the paired flap portions 17, 17 mentioned above is formed greater than the width W7 of the central portion of the through hole 7 which is formed by the prior art described before (see FIG. 21A) (D17>W7).

When the distance D17 between the paired flap portions 17, 17 is formed greater as stated above, the service life of the punch for punching the through hole 16 can be secured. That is, if the width W7 of the central portion of the through hole 7 is small, as in the conventional example, a load applied on the punch for punching the through hole 7 becomes great, and the service life of this punch is shortened. On the other hand, according to the present invention, since the distance D17 between the paired flap portions 17, 17 is formed great, a load applied on the punch for forming the through hole 16 is decreased so that the durability of this punch can be secured to reduce the manufacturing cost.

For forming the second blank 20, a punching of the through hole 16, which is to be conducted at the above-described second step, may be conducted first, and a punching of the base portion 14 and the wing-shaped portions 15, 15 which is to be conducted at the above-described first step may be conducted thereafter. Further, the second blank 20 as shown in FIG. 2 may be formed directly of metal plate material if the piercing punch and the piercing die can be processed and the pressing machine has a sufficient capacity.

In any case, the second blank 20 processed into a form as shown in FIGS. 4A to 4D is formed into the first intermediate blank 23 as shown in FIGS. 5A to 5D at the next third step. At this third step, the second blank 20 is placed between the punch and the die of the pressing machine (not shown) and is pressed strongly, and the base portion 14 of the second blank 20 and the wing-shaped portions are subjected to the bending work. Then, the second blank 20 is formed into the first intermediate blank 23 which is comprised of the pair of side walls 22, 22 laterally provided with respect to the width direction and curved portion 21 for connecting the edges of these side walls 22 in the width direction (in the lateral direction in FIGS. 5A and 5D) to each other. This curved portion 21 is formed in a semi-cylindrical shape which is discontinuous at a portion corresponding to the through hole 16 in a middle part of this first intermediate blank 23 in the length direction thereof (the lateral direction in FIG. 5A). In this manner, out of the curved portion 21 which is divided into two parts by the through hole 16, one end side thereof (the right end side in FIGS. 5A and 5B) becomes the first engagement portion 28 (see FIGS. 2 and 8) for abutting on the base unit of the valve unit, and the other end side thereof (the left end side in FIGS. 5A and 5B) becomes the second engagement portion 29 (see FIGS. 2 and 8) for abutting on the leading end of the rush adjuster.

Figure 5D:
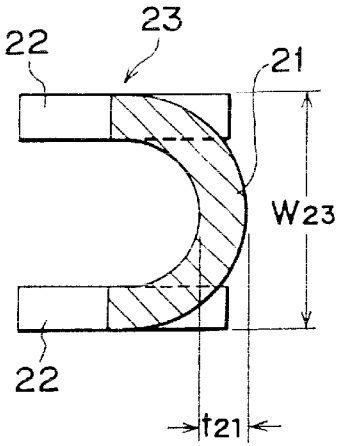
Figure 5A:
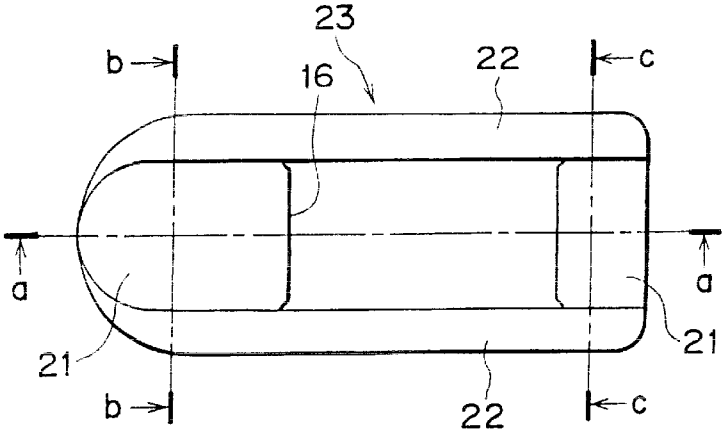
Figure 5B:
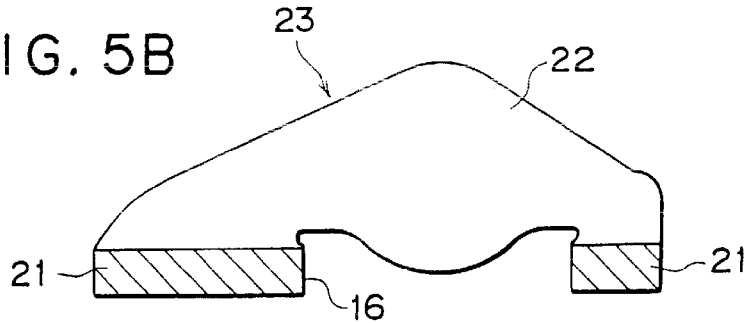
Figure 5C:
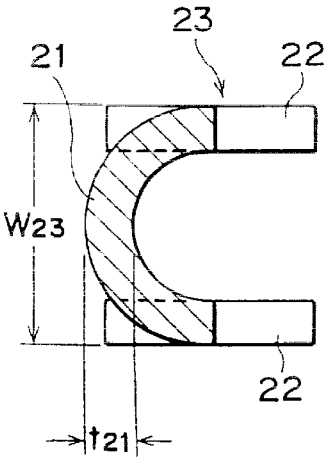
Figure 6D:
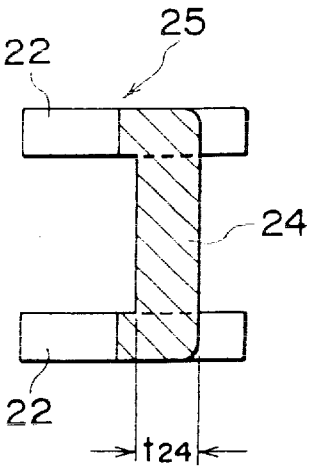
Figure 6A:
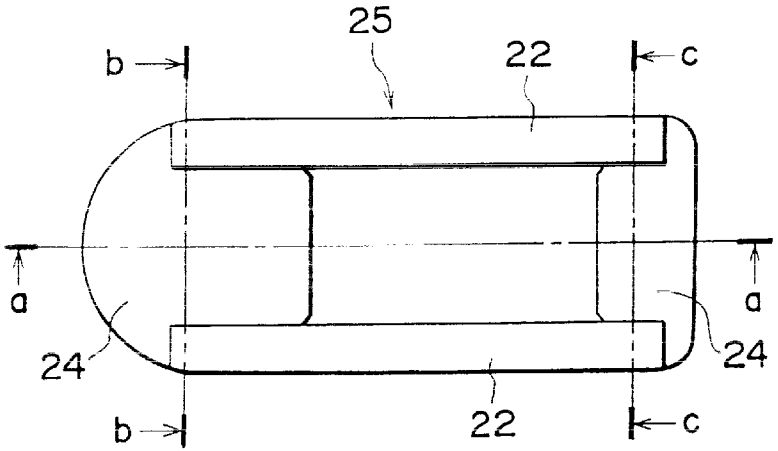
Figure 6B:
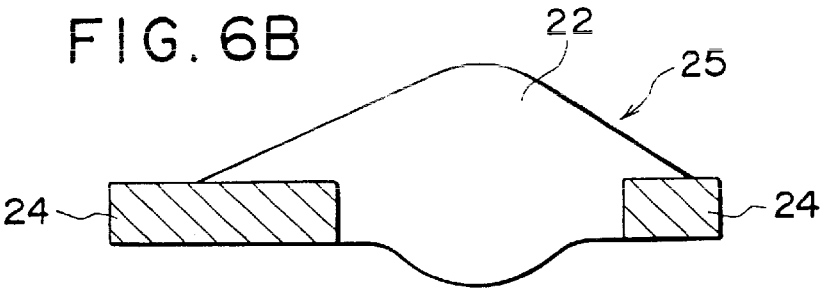
Figure 6C:
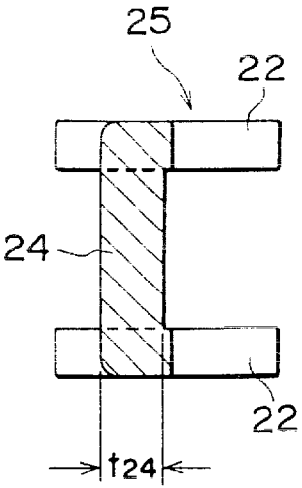

As described above, the width W23 of the first intermediate blank 23 which is a distance between the outer side surfaces of the paired side walls 22, 22 is formed smaller than the width W14 of the base portion 14 of the first and second blanks 13 and 20 mentioned above. That is, as one of characteristics of the present invention, in the first intermediate blank 23, the curved portion 21 serving as a connecting portion for connecting the edges of the paired side walls 22, 22 in the width direction thereof is formed in a substantial semi-cylindrical shape, as shown in FIGS. 5C and 5D. Since the substantial semi-cylindrical curved portion 21 is thus formed and the width of this curved portion 21 is formed smaller than the width W14 of the flat-shaped base portion 14 described above which serves as the base of the curved portion 21, the width W14 of this base portion 14 can be made greater than the width W23 of the first intermediate blank 23 which is the distance between the paired side walls 22, 22 provided laterally in the first intermediate blank 23 (W14>W23), and the distance D17 between the above-described flap portions 17, 17 can be formed great. The thickness t21 of the curved portion 21 for constituting the first intermediate blank 23 as shown in FIGS. 5A to 5D is substantially equal to the thickness t13 of the first blank 13 (t21≈t13).

Note that, out of the curved portion 21, at least the end side portion for constituting the first engagement portion 28 for abutting upon the base portion of the valve unit is subjected to the press work at a fourth step which is described later, thereby making the thickness thereof greater. In this case, for obtaining a desired thickness of the portion after the press work, it is required to restrict the shape and the size of the curved portion 21. That is, the thickness of the end side portion in the work press is determined by the selected shape and size of this curved portion 21. On the first intermediate blank 23, when the curved portion 21 is formed, the lateral pair of side walls 22, 22 are also formed simultaneously. That is, upon formation of the curved portion 21, the wing-shaped portions 15, 15 formed at the both end portions in the width direction of the first and second blanks 13 and 20 and the flap portions 17, 17 provided on the inner side edges of the through hole 16 in the central portion (see FIGS. 3 and 4) are raised to form the paired side walls 22, 22 which are substantially parallel to each other.

The curved portion 21 of the first intermediate blank 23 thus arranged is subjected to the press work at the next fourth step, thereby preparing a second intermediate blank 25 as shown in FIGS. 6A to 6D. More specifically, at the fourth step, the curved portion 21 is processed into a flat shape and the thickness thereof is increased, thereby forming the connecting portion 24 which has the thickness t24 greater than the thickness t13 of the first blank 13 (see FIG. 3B) (t13<t24). Note that in an example shown in the drawings, the base portion 14 (FIGS. 3 and 4) is subjected to the bending work until it is formed into a substantial semi-cylindrical shape at the above-mentioned third step, to obtain the curved portion 21 (FIG. 5). However, this curved portion 21 may not always take a semi-cylindrical shape, but may take an elongated semi-cylindrical shape or an elliptical semi-cylindrical shape so long as it is curved.

Figure 7B:
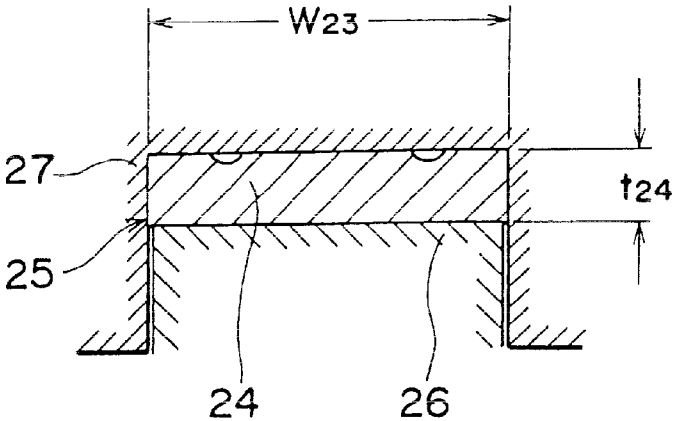
Figure 7A:
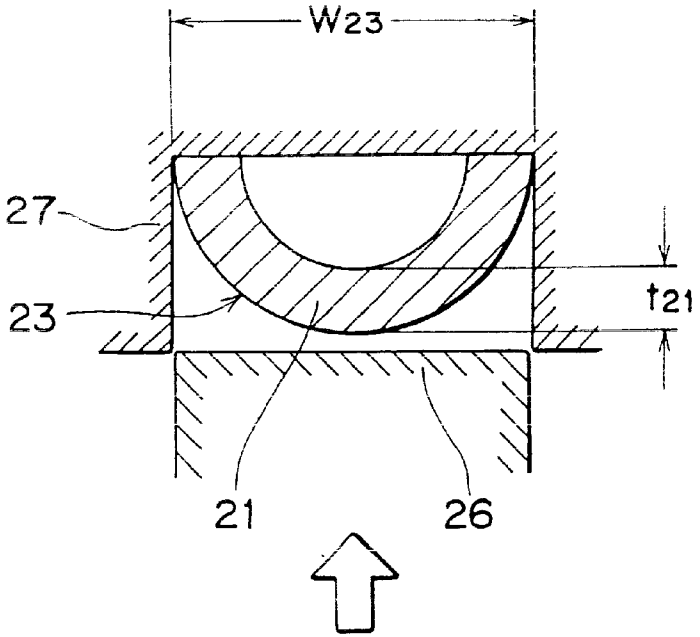

FIGS. 7A and 7B show an embodiment of the progress of the above-mentioned fourth step. In this embodiment, first as shown in FIG. 7A, the curved portion 21 of the first intermediate blank 23 is set between the punch 26 and the die 27 for the press working. Then, this punch 26 is pressed toward the die 27 to be subjected to a cold forging, whereby the curved portion 21 is plastically deformed. Consequently, a flat-plate shaped connecting portion 24 is formed as shown in FIG. 7B. When the curved portion 21 is plastically formed into the connecting portion 24 as state, the thickness thereof increases up to t24 since the curved portion 21 having an arched section becomes the flat-shaped connection portion 24. In this manner, the processing for deforming the curved portion 21 having an arched section into the flat-shaped connecting portion 24 and, at the same time, increasing the thickness thereof can be easily conducted by the press work by use of a pressing machine.

Note that, in this example, a partial break may be generated on the surface of the obtained connecting portion 24 owing to this press work, which, however, is not substantial and causes no problem for constituting a sheet metal rocker arm. Also in the embodiment shown in the drawings, the connecting portion 24 has a great thickness not only at its end portion on the curved portion 21 side, but also at the end on the other side. However, an end portion on which a great stress is applied when the sheet metal rocker arm is used is the end on the connecting portion 24 side which is provided with the first engagement portion 28 for abutting on the base portion of the valve unit. Accordingly, it is not always required to increase the thickness of the other end side of this connecting portion 24. When there is no need to increase the thickness, it is suffice if the curved portion 21 is simply plastically deformed only by an ordinary bending work, without taking the step of increasing the thickness as mentioned above, to form the flat connecting portion. However, it is advantageous in terms of the cost if the thickness of the connecting portion 24 is formed the same along the entire length thereof since a labor for such processing can be saved.

Figure 8D:
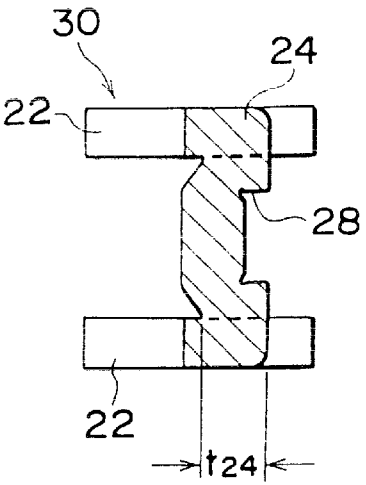
Figure 8A:
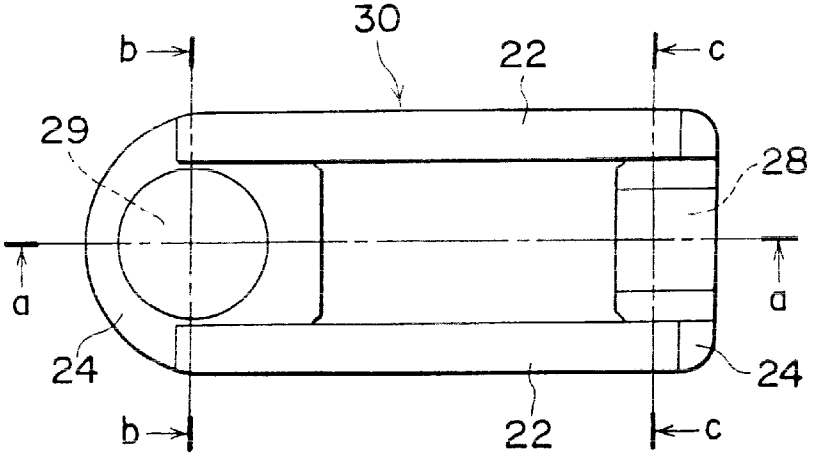
Figure 8B:
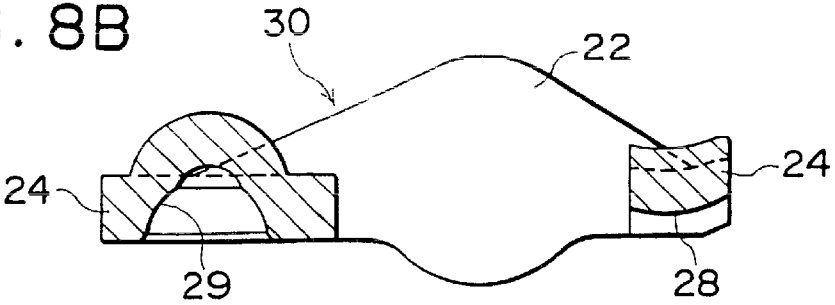
Figure 8C:
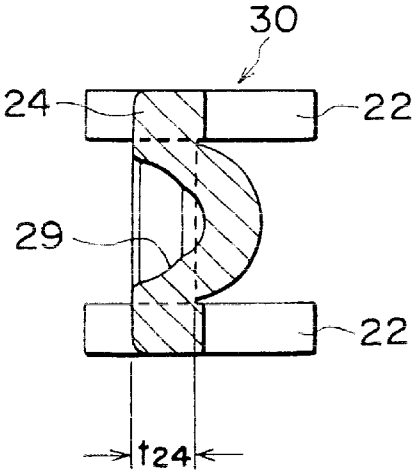
Figure 9D:
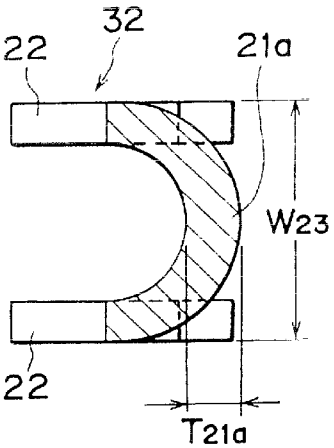
Figure 9A:
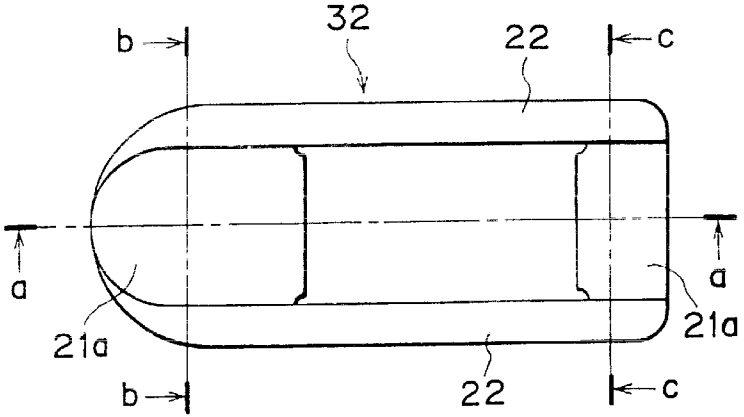
Figure 9B:
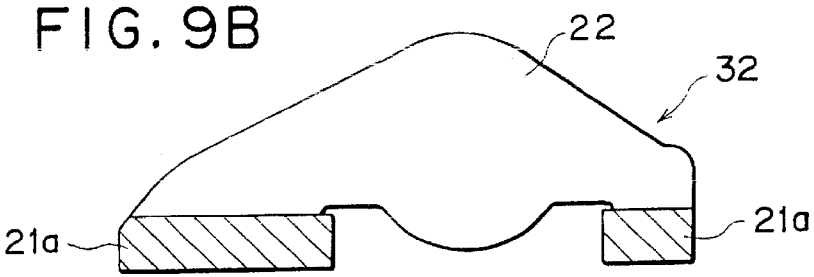
Figure 9C:
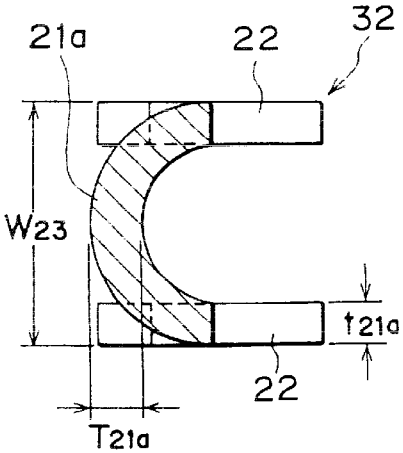

At the above fourth step, if the connecting portion 24 is formed to have a comparatively great thickness from the first intermediate blank 23 to prepare the second intermediate blank 25, this connecting portion 24 is subjected to a plastic working or a cutting working, and a grinding work, if necessary, at a next fifth step. That is, as shown in FIGS. 8A to 8D, the first engagement portion 28 for abutting the base portion of the valve unit (not shown) is formed at one end side in the length direction of the paired side walls 22, 22 (the lateral direction in FIGS. 8A and 8B), out of the connecting portion 24. Also, at the other end side, out of the connecting portion 24, in the length direction of the paired side walls 22, 22, the second engagement portion 29 for abutting on the leading edge of the rush adjuster (not shown), is formed. At the fifth step thus conducted, one end of the connecting portion 24 of the second intermediate blank 25 is set between a punch and a die of a forging machine (not shown), and is subjected to the cold forging, thereby forming the groove-like first engagement portion 28 curved in a concave manner, as shown in FIGS. 8A, 8B, and 8D. The other end of the connecting portion 24 of the second intermediate blank 25 is also set between a punch and a counterpunch of another forming machine which is not shown in the drawings, and is subjected to the cold forging, thereby forming the second engagement portion 29 which is a spherically recessed hole, as shown in FIGS. 8A, 8B, and 8C. By such processing at the fifth step, a third intermediate blank 30 is formed to comprise the first and second engagement portions 28 and 29 having the greater thickness than the thickness of the first blank 13.

The above described steps are not limited to the described order, but may be changed properly. The order of the processing steps as well as the contour or shape of an intermediate blank may be changed properly in order to meet a transfer press working or progressive processing.

On the third intermediate blank 30 thus obtained, circular holes 18, 18 are respectively formed at positions aligned with each other in middle parts of the paired side walls 22, 22 by the press work or the cutting work at a next sixth step, to be finished as a sheet metal rocker arm 31 as shown in FIG. 1, and FIGS. 2A to 2D. These circular holes 18, 18 are formed to support the both ends of the support shaft for supporting the roller rotatably, as described above. More specifically, the roller is supported rotatably around a middle part of the support shaft which is supported by the both circular holes at the both ends thereof, and at the same time, the outer peripheral surface of this roller is caused to abut on the outer peripheral surface of the cam, so that a rotating motion of the cam shaft can be transformed into a rocking motion of the sheet metal rocker arm.

Next, FIGS. 9 and 10 show a second embodiment of the method of the present invention. The characteristic of this embodiment lies in an auxiliary pressing step which intervenes between the third step and the fourth step of the first embodiment to make the thickness of the curved portion 21*a* itself greater. The other steps, that is, the first to third steps and the fourth to sixth steps of this second embodiment are conducted in the same manner as in the first embodiment. In other words, in this second embodiment, after the first to third steps which are the same as those of the first embodiment are conducted, the auxiliary pressing step mentioned above is carried out, and the fourth to sixth steps which are the same as those in the above-mentioned first embodiment are conducted, thereby obtaining a sheet metal rocker arm. FIGS. 9A to 9D show an auxiliary intermediate blank 32 which is obtained through the above-mentioned auxiliary step in this second embodiment. Of this auxiliary intermediate blank 32, the thickness of a middle part of the curved portion 21*a* in the circumferential direction is greater than the thickness of the both ends thereof. Note that the thickness of these both ends t21*a* is substantially equal to the thickness t21 of the curved portion 21 which constitutes the first intermediate blank 23 (FIGS. 3A to 3D) manufactured through the third step and the thickness t13 of the first blank 13 (FIG. 1B) which is manufactured by the first step (T21*a*>t21*a*≈t21≈t13).

Figure 10A:
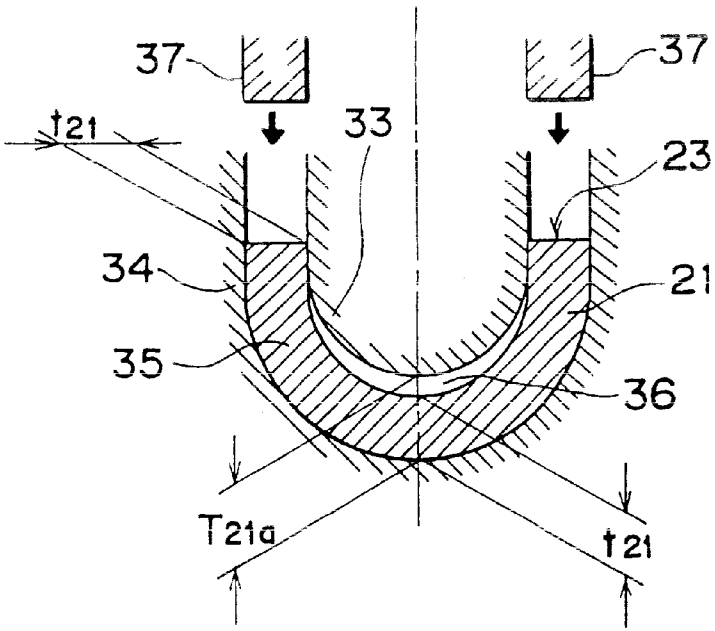
Figure 10B:
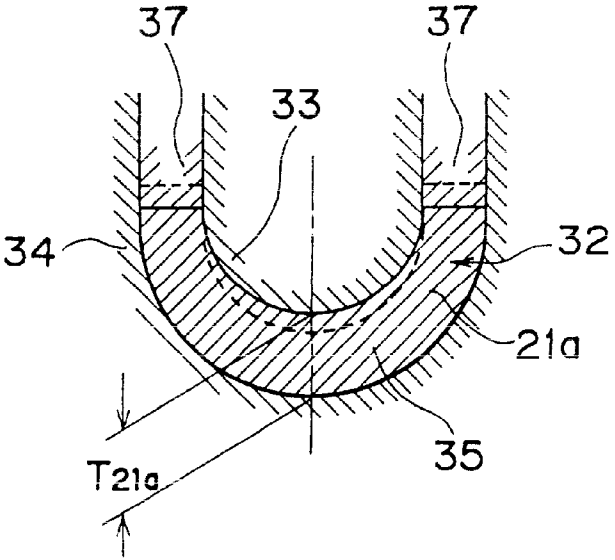

In this auxiliary pressing step, the curved portion 21 for constituting the first intermediate blank 23 is set in a cavity 35 which is formed between a pair of pressing dies 33, 34 which can be freely connected to each other and separated from each other, as shown in FIG. 10A. The width of this cavity 35 is equal to the thickness T21*a* of the middle part of the curved portion 21*a* at the middle part in the circumferential direction thereof, and equal to the thickness t21*a* of the both ends of this curved portion 21*a* at the both ends thereof. The curved portion 21 of the first intermediate blank 23 is set in this cavity 35 thus arranged, and then the paired pressing dies 33, 34 are fixed to each other so that they are not separated from each other. In this state, a gap 36 which is not filled by the curved portion 21 is formed inside the cavity 35. If the curved portion 21 is set in the cavity 35 as described, edges of the curved portion 21 of the first intermediate blank 23 in the circumferential direction is pressed by a pair of pressing punches 37, 37. As a result, this curved portion 21 is plastically deformed in a direction of filling the gap 36 to become the curved portion 21*a* which has a greater thickness at the middle part thereof in the circumferential direction than the thickness of the both ends.

If the thickness of the middle part of the curved portion 21 of the first intermediate blank 23 is increased to form the curved portion 21*a*, as described above, the fourth to sixth steps which are the same as those of the first embodiment as described are conducted to form a sheet metal rocker arm 31 having a desired shape, as shown in FIG. 1 and FIGS. 2A to 2D. In case of the present embodiment having the auxiliary pressing step as described above, it is possible to reduce a processing load which is required when the cold forging is conducted for plastically deforming the curved portion 21 to form the second intermediate blank 25 having the connecting portion 24 as shown in FIGS. 8A to 8D. It is also possible to easily adjust an increased amount of the thickness when the curved portion 21 is plastically deformed to form the connecting portion 24. That is, when the present embodiment is carried out, if the width of the middle part of the cavity 35 in the circumferential direction is increased and a certain extra amount of material is provided at the both edge portions in the circumferential direction of the curved portion 21 of the first intermediate blank 23, that is, if the circumferential length of this curved portion 21 is formed a little longer, compared with that in the above-described first embodiment, it is possible to make the thickness T21*a* of the middle part of the curved portion 21*a* after completion of the auxiliary pressing step to be a little greater.

Next, FIGS. 11A to 11D show a third embodiment of the method of the present invention. In this third embodiment, at least a pair (two pairs in the shown embodiment)of straight-line edges 38, 38 which are parallel to each other are formed in parts of the second blank 20 (the same is applied to a case of the first blank which is formed prior to this second) corresponding to the both edges in the width direction (the lateral direction in FIGS. 5A and 5B) of the curved portion 21 (see FIGS. 5A to 5D) of the first intermediate blank 23 which is obtained by bending this second blank 20. Then, when the auxiliary pressing step of the second embodiment is to be conducted, the leading edges of the pressing punches 37, 37 (FIGS. 10A and 10B) are caused to abut on these straight-line edges 38, 38. When the leading edges of the pressing punches 37, 37 are thus caused to abut on the straight-line edges 38, 38, forces of these pressing punches 37, 37 are effectively transmitted to the curved portion 21, and the processing for forming the curved portion 21*a* (FIGS. 9 and 10) by increasing the thickness of the middle part of this curved portion 21 can be conducted effectively.

Figure 2D:
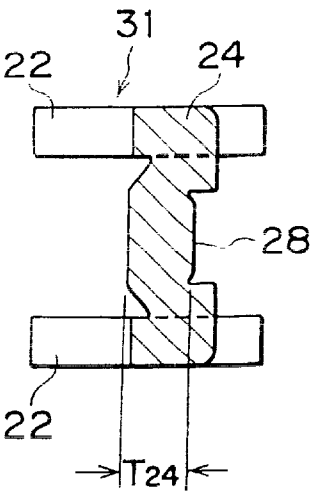
FIG. 2D is a cross-sectional view taken along c—c in FIG. 2A.
Figure 2A:
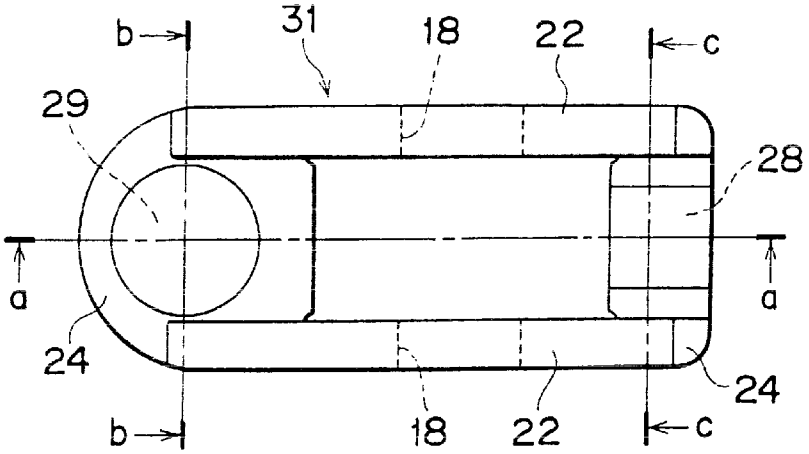
FIG. 2A is a plan view of the sheet metal rocker arm of the first embodiment.
Figure 2B:
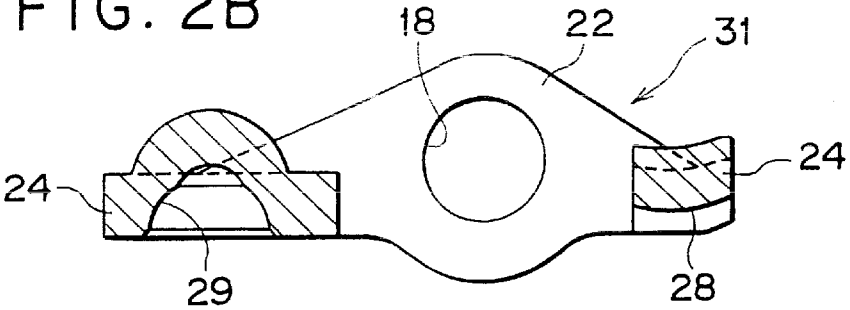
FIG. 2B is a cross-sectional view taken along a—a in FIG. 2A.
Figure 2C:
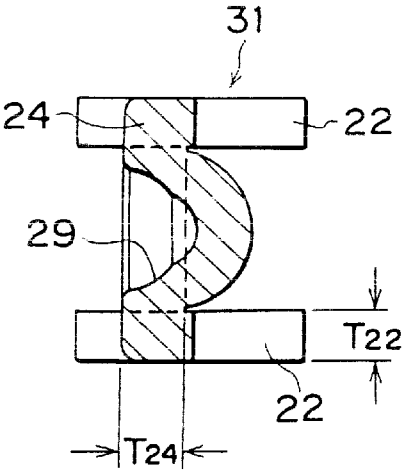
FIG. 2C is a cross-sectional view taken along b—b in FIG. 2A.

A process for thickening a portion of the connecting portion at which at least one engagement portion is provided, is not limited to the above described steps, but may be made by any other appropriate thickening steps. For example, a first blank having excessive portion(s) in the a—a direction in FIG. 2A is used, and the blank is compressed by a press work in the a—a direction so that the thickness of the engagement portion(s) may be made larger.

Though not shown in the drawings, the fourth step previously shown in FIGS. 7A and 7B as another example of the present invention is omitted and the fifth step is immediately conducted after the third step for forming the first intermediate material 23 as shown in FIGS. 4A to 4D above. At this fifth step, it is possible to increase the thickness of the curved portion 21 of this first intermediate material 23, and at the same time, to form the first and second engagement portions 28 and 29 as shown in FIGS. 8A to 8D. In such manner, instead of increasing a load required for the plastic processing a little, it is possible to reduce the number of manufacturing steps, thereby shortening the time required for manufacturing the sheet metal rocker arm by use of the reduced number of pressing machines.

The present invention is not limited to the above-mentioned embodiments, but can be modified in various manners. For example, embodiments illustrated each in the drawings has a structure in which the roller engaged with the cam is pivotally supported in the middle part, and first and second engagement portions 28 and 29 for abutting respectively on the valve unit and the rush adjuster are formed at the both end portions thereof. On the other hand, the present invention is applicable to a sheet metal rocker arm which has first through holes located at positions in middle parts in the length direction of the both side walls at which they are aligned with each other and second through holes at one end in the length direction of these side walls at which they are aligned with each other. In case of such sheet metal rocker arm, a pivot for supporting the sheet metal rocker arm rockably at a fixed part can be inserted into these first through holes, while the both ends of the support shaft for supporting rotatably the roller engaged with the cam can be supported by the second through holes. In addition, an engagement portion for abutting the base end portion of the valve unit on one end portion in the length direction of the both side walls, out of the connecting portion, is formed.

Further, as the engagement portion for abutting on the base end portion of the valve unit, a screw hole may be used, instead of the groove-like concave surface as shown in the drawings. Such screw hole is formed by a lathing and a tapping, and a screw for adjusting a tappet is threadably engaged with the screw hole when assembled in the engine. Also, when such screw hole is formed, it is important to maintain the thickness of the engagement portion mentioned above for increasing the length of the threadable engagement between the screw hole and the screw, and for securing the durability of the threadably-engaged portion. Since it is possible to obtain a great thickness for the engagement portion by the press work according to the present invention, the present invention can meet such requirement. That is, according to a rocker arm made of sheet metal in a unitary unit of the prior art, the length of the screw hole can not be made great enough so that the strength of the threadably-engaged portion between the screw hole and the screw is insufficient as it is. Consequently, it is required to connect a separate part with a screw hole formed thereon to the body of the rocker arm by welding, which is disadvantageous in terms of the cost. Meanwhile, according to the present invention, it is possible to provide a screw hole having a sufficient length by maintaining a sufficient thickness for the engagement portion without using such separate part, so as to solve the conventional problem as mentioned above.

Note that, when this invention is carried out, the thickness t24 of the connecting portion 24 for forming the first and second engagement portions 28 and 29 (see FIGS. 8A to 8D, for example) is formed to be greater than the thickness t13 of the first blank 13 (see FIGS. 3A to 3D) which is at the same time the thickness of the paired side walls 22, 22 (see, for example, FIGS. 6A to 6D and FIGS. 7A to 7D) by 5% to 40% {t24=(1.05 to 1.4) t13)}, and more preferably by 15% to 25% {t24=(1.15 to 1.25) t13}. For example, when the sheet metal rocker arm 31 is manufactured to be assembled in an ordinary car engine, if the thickness t13 of the first blank 13 is formed to be 3.2 mm, the thickness t24 of the connecting portion 24 is formed to be 3.35 mm to 4.5 mm, and more preferably, 3.7 mm to 4.0 mm. If the relation between the both thicknesses t13 and t24 is restricted within the above-mentioned range, the effects of the present invention can be obtained fully.

As a metal material from which the first blank is punched, low carbon case-hardened steel such as SCr420M, SCM415M, SC30M, and the like, are preferably used. Moreover, it is preferable to form, carburized and quenched layer having the depth of 0.3 mm to 0.8 mm at least at surface portions of the obtained sheet metal rocker arm 31, in contact with another member when the rocker arm is in use in a state of being assembled in the engine, that is, in the side surfaces of the first and second engagement portions 28 and 29 and the side walls 22, 22, in order to maintain the abrasion-proof performance thereof, thereby making the surface hardness of such portions to be Hv 653 (HR C58) or more.

Since the sheet metal rocker arm and the method of manufacturing thereof according to the present invention are structured and carried out as described, it is possible to reduce a stress acting on the connecting portion including the engagement portions to which a large force is applied, thereby enhancing the strength and the rigidity of the rocker arm. Also since the sheet metal rocker arm is integrally structured, it is possible to reduce the number of the manufacturing steps and the number of constituent parts, thereby reducing the cost, enhancing the accuracy, and simplifying the arrangement. Further, since there is no need to introduce special devices, and the manufacturing process can be easily automated, a sheet metal rocker arm with a high quality can be realized at a low cost.

Figure 20A:
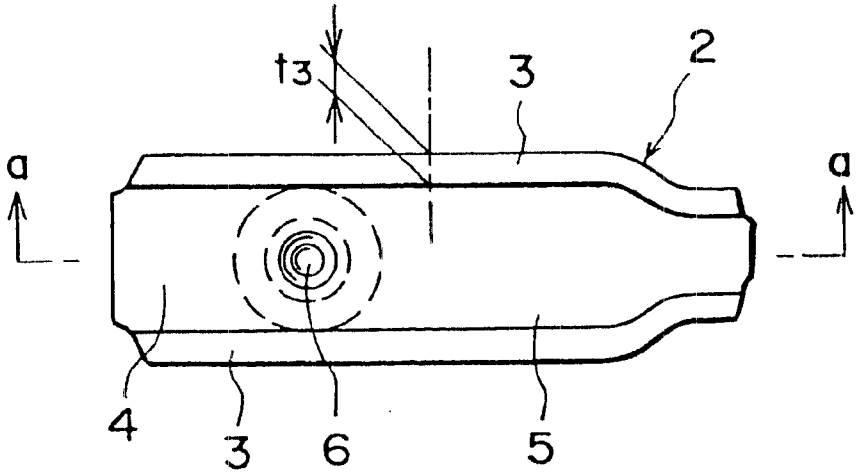
FIG. 20A PRIOR ART
FIG. 20A and FIG. 20B show the first intermediate blank manufactured by the second step in the same manner.
Figure 20B:
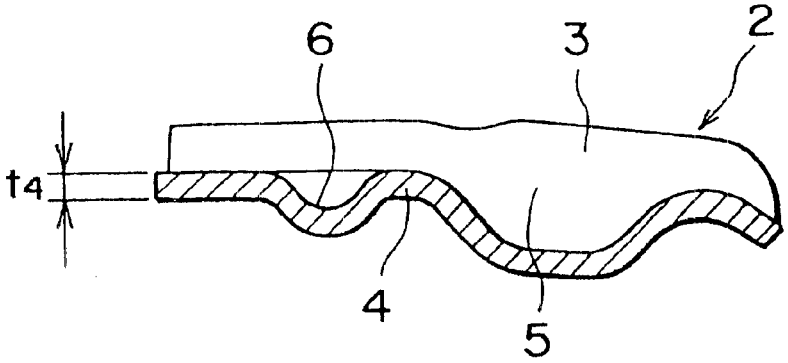
FIG. 20B PRIOR ART
Figure 21B:
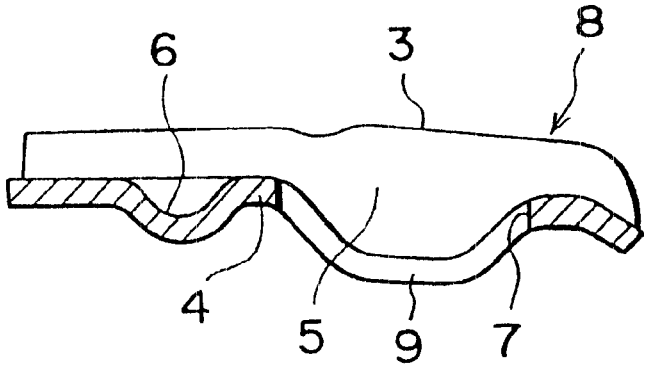
FIG. 21B PRIOR ART
Figure 22A:
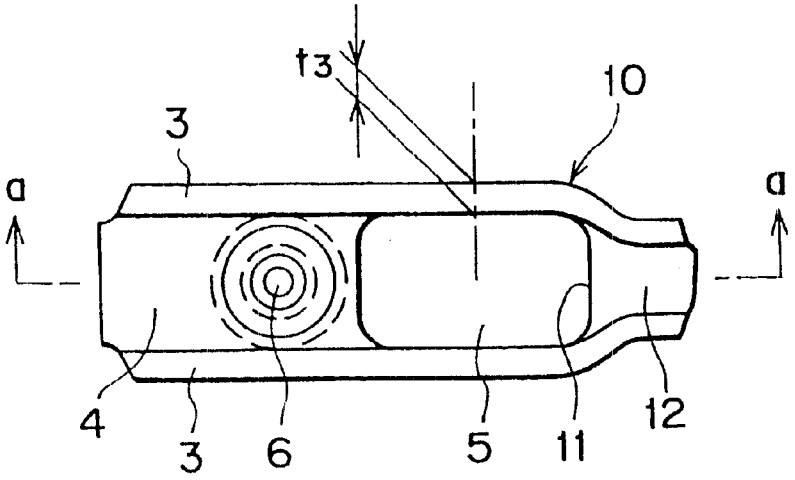
FIG. 22A PRIOR ART
Figure 22B:
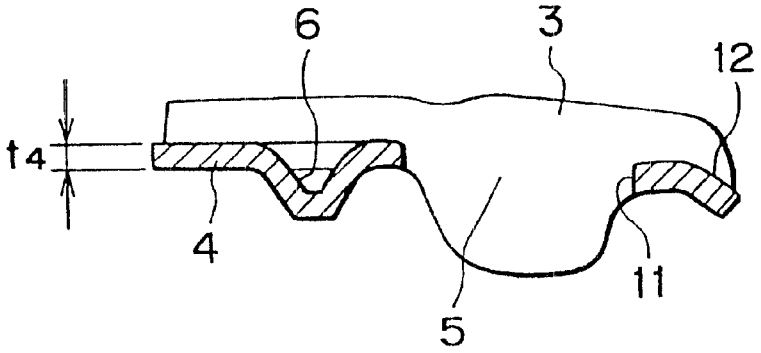
FIG. 22B PRIOR ART

FIG. 12 shows a first embodiment of a cam follower provided with a sheet metal rocker arm according to the present invention. A sheet metal rocker arm 113 is manufactured by punching of a metal plate of low carbon steel, case-hardened steel, or the like, and then is subjected to a bending work, so as to have a pair of side walls 103, 103 substantially parallel to each other, and a connecting portion (see 24 in FIG. 1 and 4 in FIGS. 20 to 22) for connecting these side walls 103, 103 to each other. Note that such sheet metal rocker arm 113 is manufactured by the method, for example, described above. However, the manufacturing method of this sheet metal rocker arm 113 itself is not specially limited. Also, it is not always required to form this sheet metal rocker arm from one metal plate. For example, the paired side walls 103, 103 and the connecting portion may be manufactured separately, and these members separately manufactured may be connected to each other by welding thereafter. In such case, the thickness of the connecting portion in which a large stress is generated when engaged with a valve unit can be formed greater than the thickness of the paired side walls 103, 103 in which not so great stress is generated. Further, when the sheet metal rocker arm 113 is manufactured from one metal plate, the thickness of a part corresponding to the connecting portion may be formed greater by a thickness-increasing processing. Since the importance of the present invention lies in the paired side walls 103, 103, the manufacturing method of the sheet metal rocker arm 113 itself is not restricted in this embodiment. The forms and structures of portions other than the side walls 103, 103 may be different from those shown in the drawings. Moreover, the positions of the portions for supporting the roller, on the paired side walls 103, 103, are not limited to the middle parts in the length direction described above, but may at the end portions in the length direction.

In either case, at the positions aligned to each other on the paired side walls 103, 103 for constituting the sheet metal rocker arm 113, there are formed a pair of through holes 114, 114. Then, a pivot 115 is formed to bridge over these both through holes 114, 114. This pivot 115 is formed of carbon steel such as bearing steel (preferably into a hollow cylindrical form), a middle part on the outer peripheral surface thereof is hardened by quenching, but the both end portions thereof remain soft (raw) without being hardened. Chamfered portions 116, 116 formed as conic concave surfaces are formed over the entire peripheral edges of the open outer ends (the ends opposite to each other) of the through holes 114, 114, respectively. Further, a roller 117 which is formed of bearing steel or ceramic into a cylindrical form is supported by a radial needle bearing 118 rotatably around a middle part of the pivot 115 and part sandwiched between the paired side walls 103, 103.

The pivot 115 is fixed to bridge over the paired side walls 103, 103 with the both ends thereof caulked and spread toward the inner peripheral surfaces of the both through holes 114, 114. That is, in a state that the both ends of the pivot 115 are positioned in the both through holes 114, 114, the leading edge of a caulking tool (not shown) having an annular and wedge-like edge is strongly urged on the both ends of this pivot 115. Then, parts on the both ends near the outer diameter of the pivot 15 are plastically deformed outward in the radial direction, so as to caulk and fix the outer peripheral surfaces of the both ends of this pivot 15 toward the chamfered portions 116, 116. In this state, there is no chance of this pivot for being drawn out of the both through holes 114, 114 or rotating inside the both through holes 114, 114.

Figure 12A:
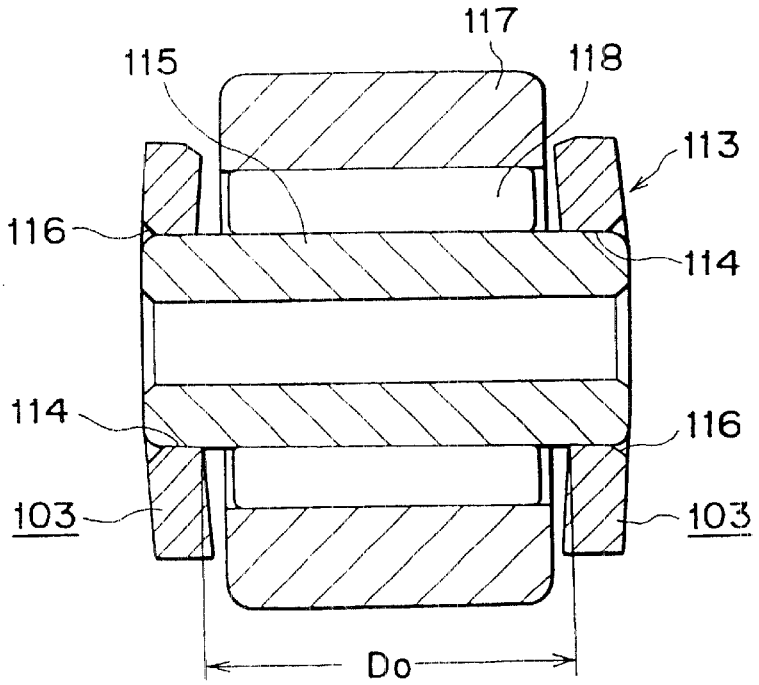
FIG. 12A and FIG. 12B show a first embodiment of a cam follower provided with a sheet metal rocker arm according to the present invention.
Figure 12B:
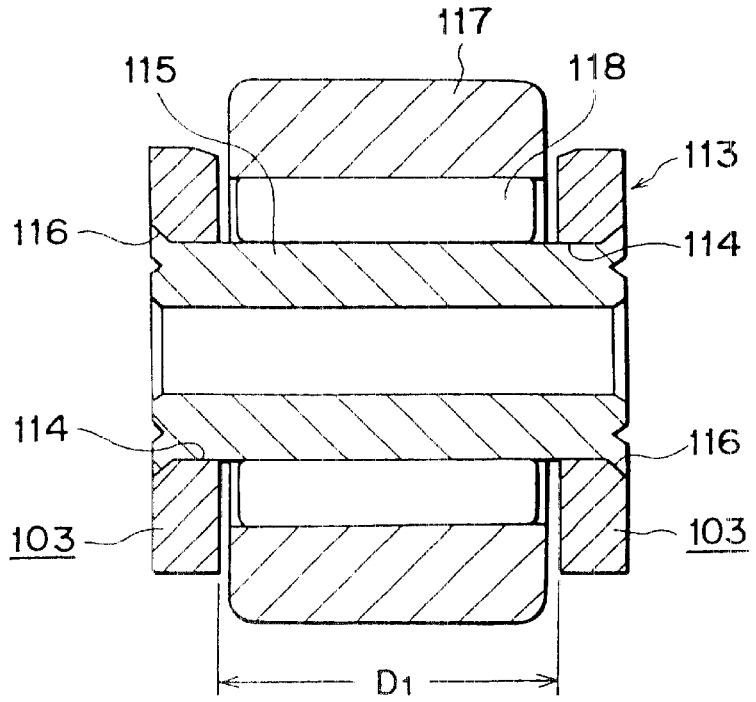

Specially, according to the present invention, in a state prior to the caulking of the both ends of the pivot 115 shown in FIG. 12A, a distance Do between the through holes 114, 114 formed on the paired side walls 103, 103 is set to be greater than the distance D1 which is the same space between the side walls in a state that the both ends of the pivot 115 is caulked as shown in FIG. 12B (Do>D1). That is, in case of the present embodiment, as shown in FIG. 12A in an exaggerated manner, the side walls 103, 103 are curved in such a manner that the inner side surfaces thereof (the side surfaces opposite to each other) become concave surfaces to have arched sections. Then, as shown in FIG. 12B, in a state that the both ends of the pivot 115 is caulked, the paired side walls 103, 103 become parallel to each other.

That is, when a cam follower provided with a sheet metal rocker arm as shown in FIG. 12B is to be assembled, in a state that the roller 117 and the radial needle bearing 118 are disposed between the paired side walls 103, 103, the pivot 115 is inserted through the roller 117, the radial needle bearing 118, and the paired through holes 114, 114, and thereafter, the both ends of this pivot 115 is caulked toward the inner peripheral surfaces of these both through holes 114, 114. In this case, the caulked portions are strongly pressed upon the chamfered portions 116, 116, and the portions at which the through holes 114, 114 are formed, out of the paired side walls 103, 103, are strongly pressed toward each other. Consequently, the side walls 103, 103 are elastically deformed so that the inner side surfaces of the side walls 103, 103 and the both end surfaces of the roller 117 in the axial direction are parallel to each other, as shown in FIG. 12B.

As described, since the inner side surfaces of the side walls 103, 103 and the both end surfaces of the roller 117 in the axial direction are parallel to each other in a state that the assembling has been completed, even when this roller 117 is displaced in the axial direction and the inner side surface of either of the side walls 103 is slidably contact with the end surface of the roller 117 in the axial direction, an area for the slidable contact can be sufficiently secured. As a result, it is possible to sufficiently form a oil film for reducing friction between the both surfaces in this sliding contact portion, whereby the resistance required for rotating the roller 117 can be reduced and an amount of abrasion of this roller 117 and the above-mentioned sheet metal rocker arm 113 can be decreased.

Figure 13:
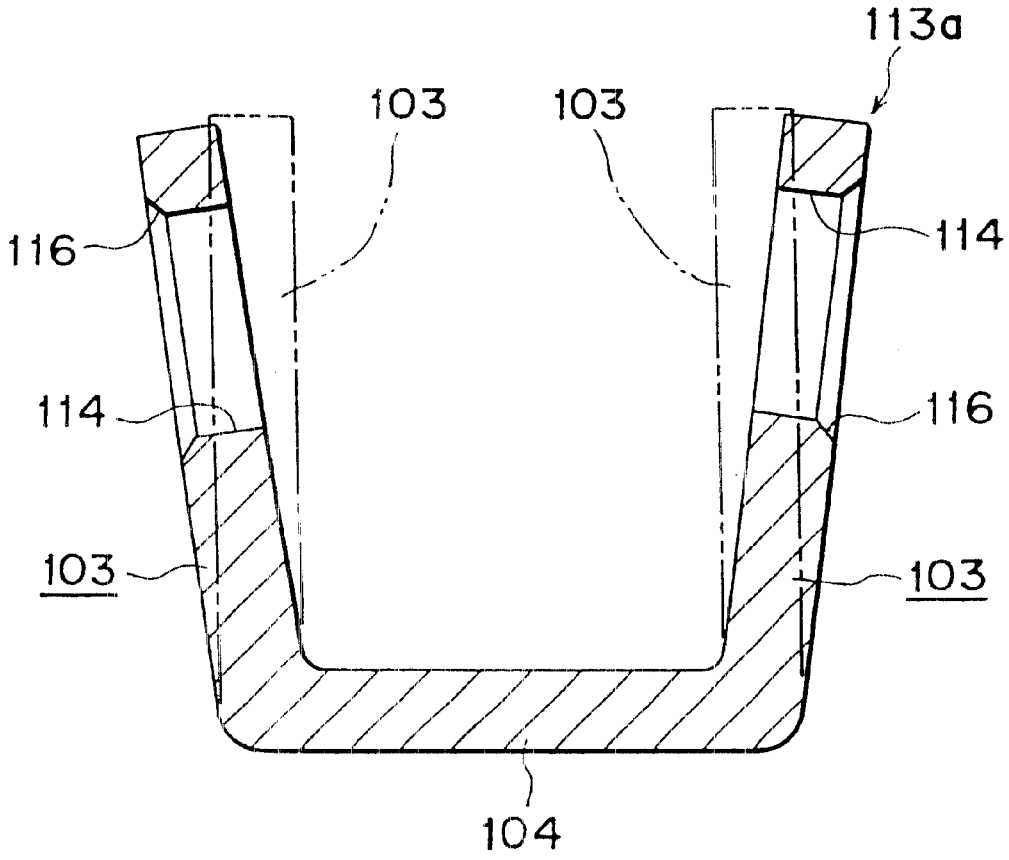
FIG. 13 is a partial schematic cross sectional view of a sheet metal rocker arm according to a second embodiment of the present invention.

Next, FIG. 13 shows a second embodiment of a cam follower provided with a sheet metal rocker arm according to the present invention. In this example, the edges (the lower edges in FIG. 13) in the width direction of the respective portions, out of the paired side walls 103, 103, at which the through holes 114, 114 for fixing the both ends of the pivot 115 (see FIG. 12) are formed are connected to each other by the connecting portion 104. Then, the respective through holes 114 and 114 are formed at positions aligned with each other near the opposite edges of the respective side walls 103, 103. When the present invention is applied to a sheet metal rocker arm 113*a* in such a form, a distance between the side walls 103, 103 is, as indicated by the solid line in an exaggerated manner in FIG. 13, is made wider near the edges at which the through holes 114, 114 are formed, and made narrower near the opposite edges, in a state prior to the caulking of the both ends of the pivot 115. When the both ends of this pivot 115 are caulked to connect and fix the both ends of the pivot 115 to the both side walls 103, 103, the distance between the side walls 103, 103 near the opposite ends is narrowed so that the inner side surfaces of the both side walls 103, 103 become parallel to each other. The other structures and effects are the same as those in the first example described before.

When the present invention is carried out, it is preferable to set the degree of parallelism between the pivot 115 (FIGS. 12 and 13) and the valve engagement portion (reference numeral 28 in FIG. 1 and 12 in FIG. 6) (a difference in the evenness assuming that one of the members is moved in parallel to be superposed on the other) to be 0.010 mm or less, for preventing a partial load to secure the durability. For the same reason, it is preferable to set the degree of rectangularity of the through holes 114, 114 formed on the side walls 103, 103 with respect to these side walls 103, 103 (a difference in the evenness of the side walls 3, 3 with respect to a virtual flat plane making a right angle with the central axes of these through holes 114, 114) to be 0.025 mm or less. It is also preferable to set the surface roughness of the valve engagement portion 112 to be 0.4a $\mu$Ra) or less, and the surface roughness of a pivot portion (reference numeral 29 in FIG. 1 and 6 in FIG. 6) to be 3.2S (R max) or less, respectively, to prevent abrasion of the base end portion of the valve unit which is in contact with these portions 12 and 6, or the leading edge of the rush adjuster. Further, it is preferable to set the degree of rectangularity of wall portions which are provided on the both sides of the valve engagement portion in the width direction to be 0.050 mm or less, the degree of concentricity between the paired through holes 114, 114 to be 0.006 mm or less, the degree of true circularity of the through holes 114, 114 to be 0.005 mm or less, and the surface roughness of the inner peripheral surfaces of the through holes 114, 114 to be 0.4a or less, respectively, for maintaining the performance of the cam follower provided with a sheet metal rocker arm. To satisfy these requirements, the sheet metal rocker arms 113*a*, 113*a* are subjected to a cutting work, a polishing work, and a necessary machine work, in addition to a sizing by a press work.

Since a cam follower provided with a sheet metal rocker arm according to the present invention and an assembling method thereof are structured and operated as described above, it is possible to realize a cam follower provided with a sheet metal rocker arm which is capable of rotating a roller with a small force and has an excellent durability by reducing abrasion of the constituent parts thereof.

Figure 14:
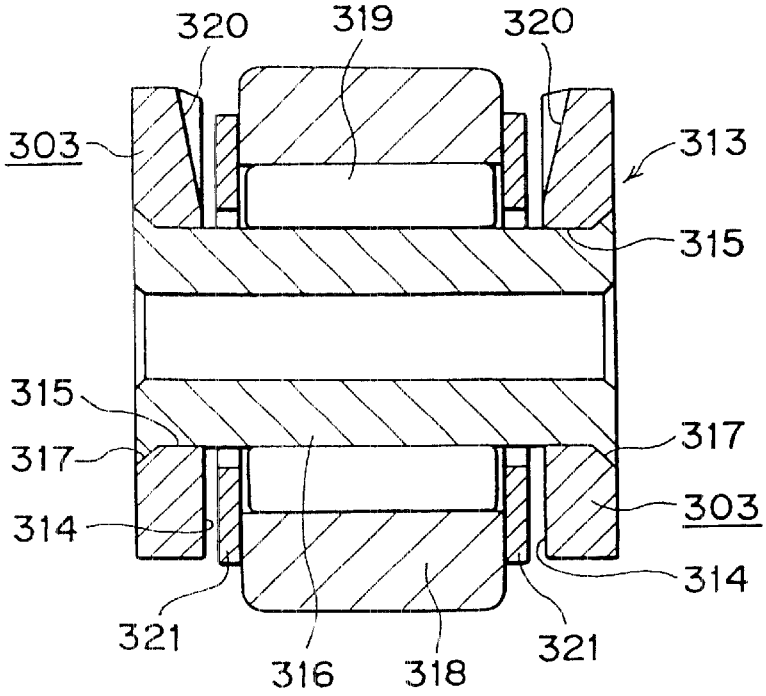
FIG. 14 is a cross sectional view for showing a third embodiment of a cam follower provided with a sheet metal rocker arm according to the present invention.
Figure 15:
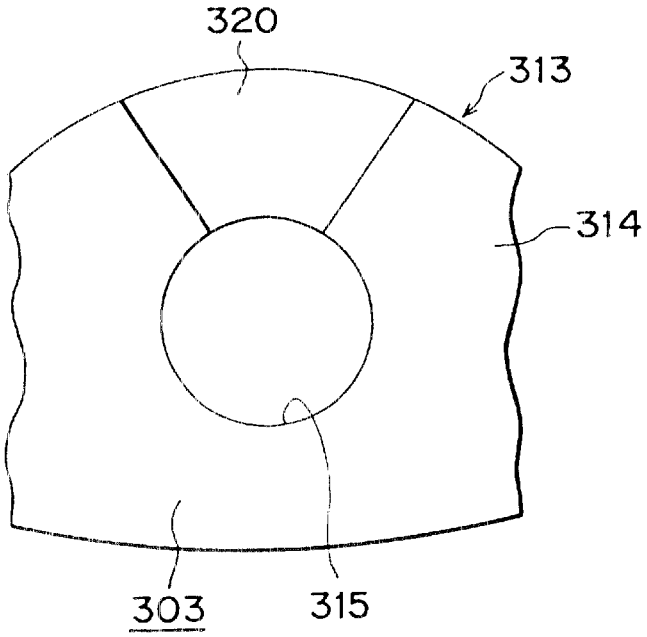
FIG. 15 is a view for showing an inner side surface of a side wall according to the third embodiment.

FIGS. 14 and 15 show a third embodiment of a cam follower provided with a sheet metal rocker arm according to the present invention. A sheet metal rocker arm 313 is manufactured by punching a metal material such as a low carbon steel plate, case hardened steel plate, or the like, to be comprised of a pair of side walls 303, 303 which are substantially parallel to each other, and a connecting portion 304 (reference numeral 24 in FIG. 1 and 4 in FIGS. 20 to 22) for connecting these side walls 303, 303 to each other. Such a sheet metal rocker arm 313 may be manufactured, for example, by the method as described above. However, a manufacturing method of this sheet metal rocker arm 313 itself is not specially limited. Also, it is not always required to form this sheet metal rocker arm 313 from one metal plate. For example, the paired side walls 303, 303 and the whole or part of the connecting portion 304 may be manufactured separately and then, these separately-manufactured parts may be connected to each other by welding. In this case, the thickness of the connecting portion 304 in which a large stress is generated when the connection portion 304 is engaged with a valve unit can be formed to be greater than the thickness of the side walls 304, 304 in which no large stress is generated. Moreover, even when the sheet metal rocker arm 313 is manufactured from one metal plate, the thickness of a portion corresponding to the connecting portion 304 can be formed to be greater by the thickness-increasing processing. However, since the gist of this embodiment lies in an arrangement of the engagement portion between the inner side surfaces of the paired side walls 303, 303 and the both ends of the roller 318 in the axial direction, any kind of manufacturing method of the sheet metal rocker arm 313 can be employed in this embodiment. The forms and the structures of the portions other than the side walls 303, 303 may be different from those shown in the drawings. In addition, the positions of the portions on the side walls 303, 303 for supporting the roller are not limited to the middle parts in the length direction, but may be at the ends in the length direction.

In either case, the paired through holes 315, 315 are formed at the positions aligned to each other on the paired side walls for constituting the sheet metal rocker arm 313. Then, a pivot 316 is bridged over these both through holes 315, 315. This pivot 316 is formed of carbon steel such as a bearing steel (preferably into a hollow cylindrical form), and the outer peripheral surface of a middle part thereof is hardened by treatment such as an induction hardening, while the both ends thereof remain soft (raw) without being hardened. Chamfered portions 317, 317 formed as conic concave surfaces are formed over the entire peripheral edges (the edges opposite to each other) open to the outer ends of the through holes 315, 315, respectively. Further, a cylindrical roller 318 made of bearing steel or ceramic is supported by a needle bearing 319 rotatably on the periphery of a middle part of the pivot 316 which is a part between the paired side walls 303, 303.

The pivot 316 is fixed to bridge over the paired side walls 303, 303 by caulking the both ends thereof toward the inner peripheral surfaces of the both through holes 315, 315. That is, in a state that the both ends of the pivot 316 are positioned inside the both through holes 315, 315, the leading edge of an caulking tool (not shown) having an annular pointed edge in a wedge form is strongly urged or pressed on the both ends of this pivot 316. Then, parts of the both ends near the outer diameter of the pivot 316 are plastically deformed outward in the radial direction, so as to caulk and fix the outer peripheral surfaces of the both ends of this pivot 316 toward the chamfered portions 317, 317. In this state, there is no chance of this pivot 316 of being drawn out of the both through holes 315, 315 or rotating inside the both through holes 315, 315.

Specially, in case of the shown embodiment, recesses 320, 320 for receiving lubricating oil are respectively formed on the inner side surfaces 314, 314 of the side walls 303, 303. Each of these recesses 320, 320 is opened toward the outer edge of each of the side walls 303, 303 (the upper edges in FIGS. 14 and 15) at one end thereof (the upper end in FIGS. 14 and 15) and is inclined toward the other end thereof (the lower end in FIGS. 14 and 15) to be shallower. In the shown embodiment, the recesses 320, 320 are formed such that the other edges thereof reach the peripheries of the through holes 315, 315.

Further, in the shown example, washers 321, 321 made of a metal plate such as a steel plate or a copper plate are formed between the inner side surfaces of the side walls 303, 303 and the both ends of the roller 318 in the axial direction. The inner diameter of each of these washer 321, 321 is formed to be sufficiently greater than the outer diameter of the middle part of the pivot 316. Consequently, these washers 321, 321 are provided between the inner side surfaces of the side walls 303, 303 and the both ends of the roller 318 in the axial direction rotatably around the middle part of the pivot 316.

With the cam follower provided with a sheet metal rocker arm according to the present invention having a structure as mentioned above, it is possible to reduce a frictional resistance between the end surfaces of the roller 318 in the axial direction and the inner side surfaces of the side walls 303, 303. That is, the lubricating oil, which is supplied to the environs of the cam follower provided with the sheet metal rocker arm by an action of a lubricating pump (not shown) incorporated in the engine, is supplied with efficiency into the recesses 320, 320 through openings at ends of the recesses 320, 320. The lubricating oil thus supplied into the recesses 320, 320 is successively diffused inside the spaces between the end surfaces of the roller in the axial direction, and the inner side surfaces of the side walls 303, 303, to form an oil film between the both side surfaces of the washers 321, 321, the end surface of the roller 318 in the axial direction, and the inner side surfaces of the side walls 303, 303. As a result, it is possible to reduce a rotational resistance of the roller 318 and to decrease abrasion between this roller 318 and the sheet metal rocker arm 313. Moreover, in the shown embodiment, since the washer 321, 321 are provided, oil films are provided at two locations in each of the spaces between the end surfaces of the roller 318 in the axial direction and the inner side surfaces of the side walls 303, 303. Consequently, the effect of reducing the rotational resistance and abrasion mentioned above is further enhanced.

Figure 16:
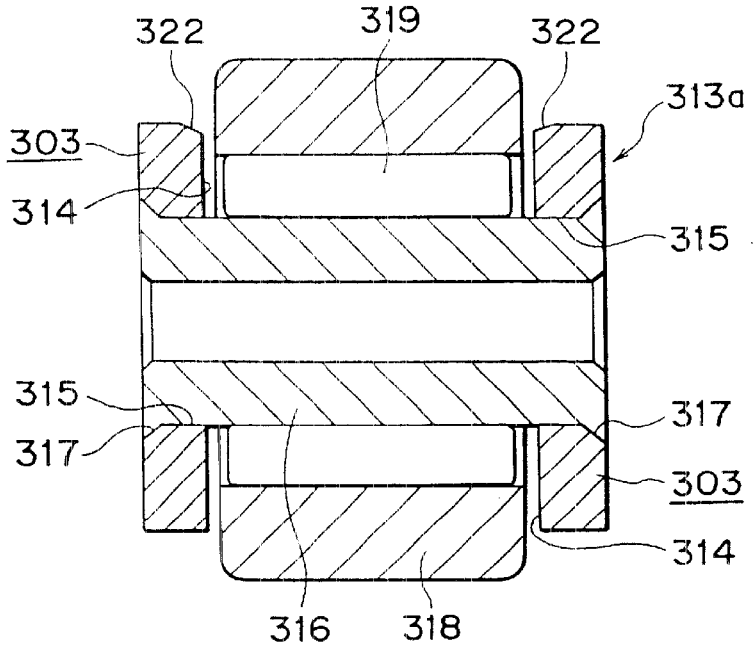
FIG. 16 is a cross sectional view for showing a fourth embodiment of a cam follower provided with a sheet metal rocker arm according to the present invention.

Next, FIG. 16 shows a fourth embodiment of a cam follower of the present invention. In the present embodiment, the degree of flatness of the inner side surfaces 314, 314 of the side walls 303, 303 for constituting the sheet metal rocker arm 313*a* (the distance between a first virtual straight line which is in contact with the most protruding part and a second virtual straight line which is parallel to this first virtual straight line and in contact with the most depressed part) is set to be 10 $\mu$or less. Also, the surface roughness of the inner side surfaces of the side walls 303, 303 is set to be 0.3 $\mu$ Ra or less.

Further, the inner side surfaces 314, 314 of the side walls 303, 303 are subjected to a solid lubricating film coating or a soft nitriding, thereby reducing the frictional coefficient of these inner side surfaces. This solid lubricating film coating is properly carried out by forming a film of molybdenum disulfide (MoS2) on a chemically processed film. As the soft nitriding, a Tufftride processing or a gas soft nitriding is appropriate. It is suffice if the solid lubricating film coating or the soft nitriding is conducted only on the inner side surfaces 314, 314 of the side walls 303, 303, which, however, is practically difficult by use of industrial means. Therefore, in such a case, the solid lubricating film coating or the soft nitriding is conducted over the entire surface of the sheet metal rocker arm 313*a*. With such lubricating film coating or soft nitriding, the surface hardness of the sheet metal rocker arm 313*a* is decreased because of a high processing temperature. However, a little decrease of the surface hardness of the sheet metal rocker arm 313*a* causes no substantial problem.

Also with a cam follower provided with a sheet metal rocker arm according to the present invention having a structure as described above, it is possible to reduce a frictional resistance between the end surfaces of the roller 318 in the axial direction and the inner side surfaces of the side walls 303, 303. That is, since the degree of flatness and the surface roughness of the inner side surfaces of the side walls 303, 303 are decreased (that is, the surface is made smooth), an excellent oil film can be formed between these side surfaces and the end surfaces of the roller 318 in the axial direction, so as to reduce the frictional resistance between the both side surfaces. Further, if the inner side surfaces are subjected to the solid lubricating oil coating or the soft nitriding, the frictional resistance between the both surfaces can be further reduced. Note that, though the solid lubricating film of molybdenum disulfide, or the like, is peeled off with a use over a long period of time, the frictional resistance between the both surfaces can be reduced by the time when the lubricating oil reaches the roller 318 immediately after the engine is assembled, thereby preventing the both surfaces from damages. Also, in the shown embodiment, the direction of inclined surfaces 322, 322 which are formed at the edges of the side walls 303, 303 owing to shear drop in the press work is restricted to a direction in which the lubricating oil is easily introduced to the roller 318 side.

Figure 17:
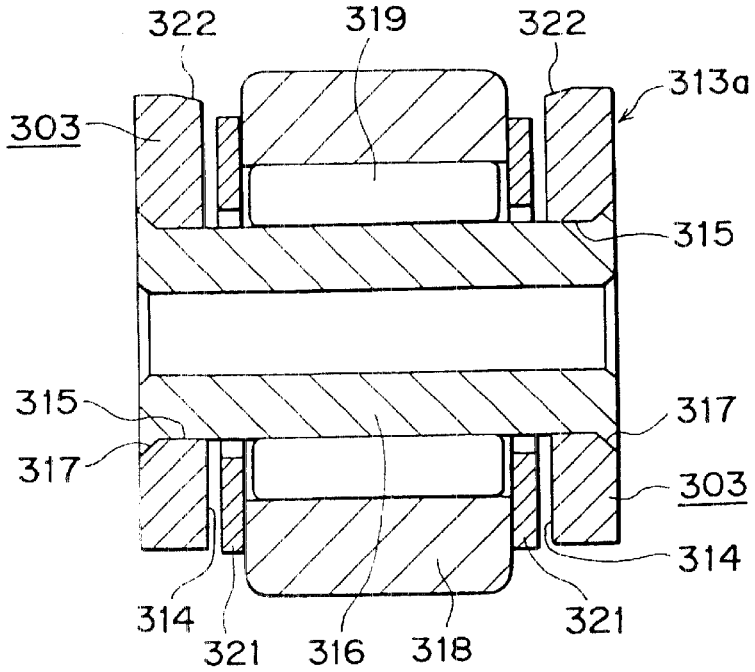
FIG. 17 is a cross sectional view for showing a fifth embodiment of this cam follower.

Subsequently, FIG. 17 shows a fifth embodiment of a cam follower according to the present invention. The present embodiment shows a structure which is the same as that of the third embodiment shown in FIGS. 14 and 15 except that the recesses 320, 320 (FIGS. 14 and 15) on the inner side surfaces 314, 314 of the side walls 303, 303 are removed. In case of the present embodiment having such structure, it is possible to reduce a rotational resistance of the roller 318 and abrasion of the other constituent parts by providing the oil films at two locations in each of the spaces between the end surfaces of the roller 318 in the axial direction and the inner side surfaces 314, 314 of the side walls. Even if the degree of parallelism between the inner side surfaces 314, 314 is deteriorated by the press work, these inner side surfaces 314, 314 are not brought into direct contact with the end surfaces of the roller 318, and this roller 318 is smoothly rotated while rotating the washer 320,320.

Figure 18:
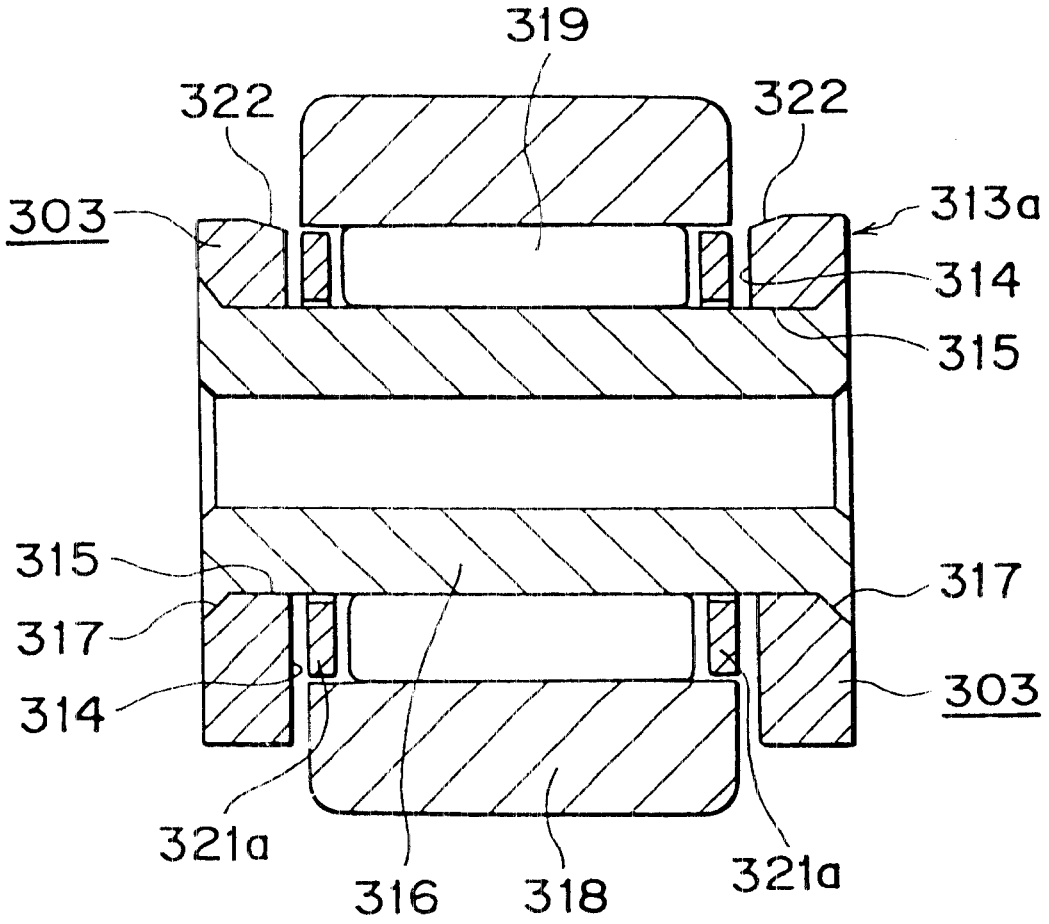
FIG. 18 is a cross sectional view for showing a sixth embodiment of this cam follower.
Figure 19A:
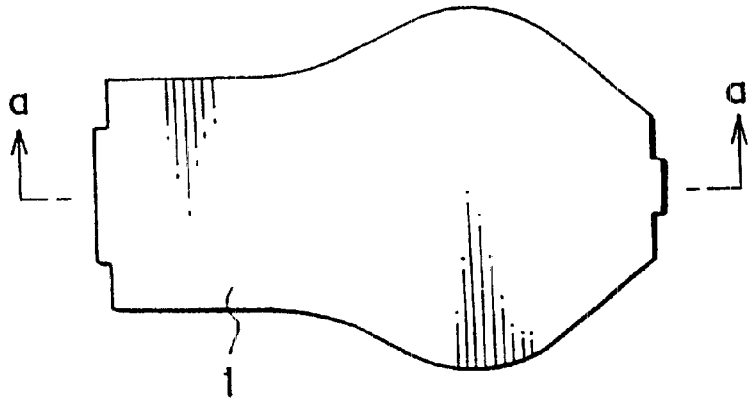
FIG. 19A PRIOR ART
FIG. 19A and FIG. 19B show a blank which is manufactured by the first step when a conventional sheet metal rocker arm is manufactured.
Figure 19B:
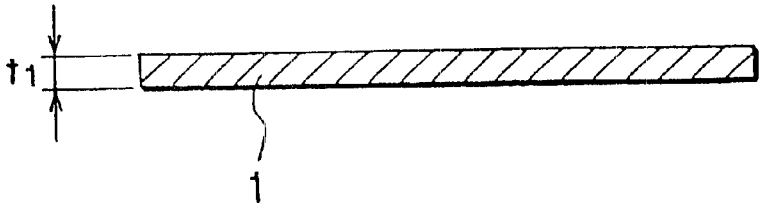
FIG. 19B PRIOR ART

Next, FIG. 18 shows a sixth embodiment of the cam follower according to the present invention. In this embodiment, the end surfaces of each needle for constituting the radial needle bearing 319 are prevented from being brought into direct contact with the inner side surfaces 314, 314 of the side walls 303, 303 by narrow washers 321*a*, 321*a* which are provided on the inner diameter side of the roller 318. In this embodiment having such structure, it is possible to allow the needles for constituting the radial needle bearing 139 to make a smooth rotational by providing the washers 321*a*, 321*a*, and to prevent a frictional movement between the end surfaces of the needles made of hard metal such as bearing steel and the inner side surfaces 314, 314 of the side walls 303, 303, thereby reducing a rotational resistance of the roller 318 and abrasion of the respective portions.

In either of the shown embodiments, the both ends of the pivot 316 are connected and fixed to the side walls 303, 303 by caulking these both ends. However, a manner of such connection and fixation between the pivot 316 and the side walls 303, 303 is not limited to the caulking as stated above. The both members may be connected by welding. That is, the pivot 316 may be manufactured of high carbon chromium bearing steel such as SUJ2, and the whole pivot 316 may be subjected to a so called through hardening, and further the both ends of this pivot 316 are welded to the side walls 303, 303. The present invention is clearly applicable to such arrangement.

Since a cam follower provided with a sheet metal rocker arm according to the present invention is structured and operated as described above, it is possible to provide a cam follower provided with a sheet metal rocker arm which is capable of rotating a roller with a small force and has an excellent durability by reducing abrasion of the respective constituent members.

What is claimed is:

1. A method of manufacturing a sheet metal rocker arm having a pair of side walls parallel to each other, a connecting portion for connecting end of both side walls in a width direction of the rocker arm, at least a pair of through holes formed at positions which are aligned with each other on both side walls for inserting a pivot cam follower, and an engagement portion provided in a part of said connecting portion, said manufacturing method comprising:

first punching, second bending and third forming press work, wherein a width of the connecting portion is reduced compared to that at the first punching step.

2. A method of manufacturing a sheet metal rocker arm having a pair of side walls parallel to each other, a connecting portion for connecting ends of both of the side walls in a width direction of the rocker arm, at least a pair of first through holes formed at positions which are aligned with each other on side walls for inserting a pivot of a cam follower, and an engagement portion provided in a part of said connecting portion, said manufacturing method comprising:

punching a sheet of metal plate to form a blank having a predetermined contour and a second through hole having four corners;

bending said blank to form both of the side walls, and concurrently forming the connecting portion; and forming part of the connecting portion to an engagement portion;

wherein said second through hole after the punching step has a recess at each of the corners.

* * * * *